US007722340B2

(12) United States Patent
Masuda et al.

(10) Patent No.: US 7,722,340 B2
(45) Date of Patent: May 25, 2010

(54) ROTARY TYPE FLUID MACHINE

(75) Inventors: Masanori Masuda, Sakai (JP); Yoshitaka Shibamoto, Sakai (JP); Kazuhiro Furusho, Sakai (JP); Takashi Shimizu, Sakai (JP); Takazo Sotojima, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 286 days.

(21) Appl. No.: 11/912,735

(22) PCT Filed: Mar. 20, 2006

(86) PCT No.: PCT/JP2006/305581

§ 371 (c)(1),
(2), (4) Date: Oct. 26, 2007

(87) PCT Pub. No.: WO2006/117940

PCT Pub. Date: Nov. 9, 2006

(65) Prior Publication Data

US 2009/0074602 A1 Mar. 19, 2009

(30) Foreign Application Priority Data

Apr. 28, 2005 (JP) ..... 2005-132543

(51) Int. Cl.
*F04C 2/063* (2006.01)

(52) U.S. Cl. ..... 418/23; 418/16; 418/22; 418/58; 418/59; 418/61.1

(58) Field of Classification Search ..... 418/22, 418/23, 28, 58, 59, 61.1, 16, 6, 11, 13
See application file for complete search history.

(56) References Cited

U.S. PATENT DOCUMENTS

| | | | | | |
|---|---|---|---|---|---|
| 904,209 | A | * | 11/1908 | Lyons et al. | 418/59 |
| 2,316,318 | A | * | 4/1943 | Davidson | 418/149 |
| 5,284,426 | A | * | 2/1994 | Strikis et al. | 418/23 |
| 5,871,342 | A | * | 2/1999 | Harte et al. | 418/23 |
| 6,077,058 | A | | 6/2000 | Saitou et al. | |
| 2006/0073051 | A1 | * | 4/2006 | Hwang et al. | 418/59 |

FOREIGN PATENT DOCUMENTS

| | | | |
|---|---|---|---|
| CN | 1166862 | C | 9/2004 |
| JP | 60-9058 | U | 6/1985 |
| JP | 61-001888 | A | 1/1986 |
| JP | 63-6009 | U | 4/1988 |
| JP | 06-159278 | A | 6/1994 |
| JP | 06-288358 | A | 10/1994 |
| JP | 07-103167 | A | 4/1995 |
| JP | 2004-301114 | A | 10/2004 |

* cited by examiner

*Primary Examiner*—Thomas E. Denion
*Assistant Examiner*—Mary A Davis
(74) *Attorney, Agent, or Firm*—Global IP Counselors

(57) ABSTRACT

A blade moves backward/forward to enter four different states, namely a first state in which the tip thereof is in sliding contact with the internal peripheral surface of an external side cylinder part, a second state in which the tip is positioned in the cutaway portion of a ring-shaped piston to thereby place only an external side cylinder chamber at rest, a third state in which the tip is positioned in the cutaway portion of an internal side cylinder part to thereby place only the external side cylinder chamber and an intermediate cylinder chamber at rest, and a whole rest state in which the tip is positioned in a blade groove to thereby place all of the cylinder chambers at rest.

10 Claims, 19 Drawing Sheets

ROTARY TYPE FLUID MACHINE

CROSS-REFERENCE TO RELATED APPLICATIONS

This U.S. National stage application claims priority under 35 U.S.C. §119(a) to Japanese Patent Application No. 2005-132543, filed in Japan on Apr. 28, 2005, the entire contents of which are hereby incorporated herein by reference.

TECHNICAL FIELD

The present invention generally relates to fluid machines of the rotary type and more particularly, to controlling the capability of a rotary type fluid machine having a plurality of cylinder chambers.

BACKGROUND ART

In the past, rotary type fluid machines with an eccentric rotary piston mechanism have been known. This eccentric rotary piston mechanism is configured such that the ring-like piston moves in an eccentric rotation motion within a ring-like cylinder chamber. As such a rotary type fluid machine, there is a compressor, such as one disclosed, for example, in JP-A-H06-288358, which is configured to compress refrigerant by the variation in volume of the cylinder chamber associated with the eccentric rotation motion of the ring-like piston.

Referring to FIG. 19, the compressor of the aforesaid patent document has a cylinder (121) having a ring-like cylinder chamber (C1, C2) and a ring-like piston (122) disposed in the cylinder chamber (C1, C2). The cylinder (121) is composed of an external side cylinder (124) and an internal side cylinder (125). These cylinders (124) and (125) are arranged concentrically with each other. In other words, the cylinder chamber (C1, C2) is defined between the external side cylinder (124) and the internal side cylinder (125), and the cylinder chamber (C1, C2) is divided by the ring-like piston (122) into an external side cylinder chamber (C1) and an internal side cylinder chamber (C2). The ring-like piston (122) is configured such that it moves in an eccentric rotation motion with respect to the center of the cylinder (121) while the external peripheral surface of the ring-like piston (122) is in contact with the internal peripheral surface of the external side cylinder (124) substantially at one point and the internal peripheral surface of the ring-like piston (122) is in contact with the external peripheral surface of the internal side cylinder (125) substantially at one point.

An external side blade (123A) is disposed on the outside of the ring-like piston (122). An internal side blade (123B) is arranged on the inside of the ring-like piston (122) such that it is positioned on an extension of the external side blade (123A). The external side blade (123A) is inserted into the external side cylinder (124) and is biased inwardly in the radial direction of the ring-like piston (122) so that its tip is in pressure contact with the external peripheral surface of the ring-like piston (122). On the other hand, the internal side blade (123B) is inserted into the internal side cylinder (125) and is biased outwardly in the radial direction of the ring-like piston (122) so that its tip is in pressure contact with the internal peripheral surface of the ring-like piston (122). The external side blade (123A) divides the external side cylinder chamber (C1) into a high pressure chamber and a low pressure chamber. The internal side blade (123B) divides the internal side cylinder chamber (C2) into a high pressure chamber and a low pressure chamber. And in the above compressor, with the eccentric rotation motion of the ring-like piston (122), the suction of fluid is carried out in the low pressure chamber of each cylinder chamber (C1, C2) while the compression of fluid is carried out in the high pressure chamber of each cylinder chamber (C1, C2).

SUMMARY OF THE INVENTION

Problems that the Invention Seeks to Overcome

However, in the compressor of the above-described patent document, the volume of each cylinder chamber (C1, C2) stays constant. This causes the problem that there is no other way than by changing the operating frequency of an electric motor to control the volume of each cylinder chamber (C1, C2). That is, especially, it is impossible to change the volume to a larger extent only by adjustment in the operating frequency of the electric motor.

With a view to overcoming the above drawbacks, the present invention was devised. Accordingly, an object of the present invention is that in a rotary type fluid machine in which a ring-like piston configured to move in an eccentric rotation motion is arranged at least in a ring-like cylinder chamber to define a plurality of cylinder chambers, at least one of the cylinder chambers is placed at rest for the control of volume.

Means for Overcoming the Problems

The present invention provides a first aspect in which a cylinder (21) which has a ring-like cylinder chamber (C1, C2); a ring-like piston (23) which is accommodated eccentrically relative to the cylinder (21) in the cylinder chamber (C1, C2) to thereby divide the cylinder chamber (C1, C2) into an external side cylinder chamber (C1) and an internal side cylinder chamber (C2); and a blade (25) which passes at least through the ring-like piston (23) to thereby divide the external side cylinder chamber (C1) into a high pressure chamber (C1-Hp) and a low pressure chamber (C1-Lp) and the internal side cylinder chamber (C2) into a high pressure chamber (C2-Hp) and a low pressure chamber (C2-Lp) are provided, wherein the cylinder (21) and the ring-like piston (23) are configured such that they move relatively in an eccentric rotation motion. On the other hand, the blade (25) is configured to be advanceable/retractable in the longitudinal direction thereof so that during one rotational movement, at least either one of the external side cylinder chamber (C1) and the internal side cylinder chamber (C2) is placed in the form of an undivided single space.

In the first aspect of the present invention, for example, if, when the external side cylinder chamber (C1) is divided by the blade (25) into the high pressure chamber (C1-Hp) and the low pressure chamber (C1-Lp) and the internal side cylinder chamber (C2) is divided by the blade (25) into the high pressure chamber (C2-Hp) and the low pressure chamber (C2-Lp), the cylinder (21) and the ring-like piston (23) move relatively in an eccentric rotation motion, then fluid is drawn into the low pressure chambers (C1-Lp, C2-Lp) while fluid is compressed in the high pressure chambers (C1-Hp, C2-Hp) in the cylinder chambers (C1, C2).

Here, for example, if the blade (25) moves backward/forward so that the external side cylinder chamber (C1) is placed in the form of an undivided single space, the external side cylinder chamber (C1) is not divided into the high pressure chamber (C1-Hp) and the low pressure chamber (C1-Lp). That is, the compression of fluid is not carried out in the external side cylinder chamber (C1). Accordingly, the compression of fluid is carried out only in the internal side cylinder chamber (C2), and the compression capability falls. The same is true for the case where the internal side cylinder chamber (C2) is placed in the form of an undivided single space.

The present invention provides a second aspect according to the first aspect in which the ring-like piston (23) is C-shaped to have a cutaway portion through which the blade (25) is allowed to pass and the blade (25) is inserted advanceably/retractably along the radial direction of the cylinder (21) into a blade groove (26) formed in a wall on the internal peripheral side of the cylinder chamber (C1, C2). On the other hand, the blade (25) moves backward/forward to enter either (i) a first state in which the tip of the blade (25) is in sliding contact with a wall surface on the external peripheral side of the cylinder chamber (C1, C2), thereby dividing the external side cylinder chamber (C1) into the high pressure chamber (C1-Hp) and the low pressure chamber (C1-Lp) and the internal side cylinder chamber (C2) into the high pressure chamber (C2-Hp) and the low pressure chamber (C1-Lp) or (ii) a second state in which the tip of the blade (25) is positioned in the cutaway portion of the ring-like piston (23), thereby placing only the external side cylinder chamber (C1) in the form of an undivided single space.

In the second aspect of the present invention, for example, if, when the blade (25) is in the first state, the cylinder (21) and the ring-like piston (23) move relatively in an eccentric rotation motion, the compression of fluid is carried out in each cylinder chamber (C1, C2). That is, in one rotational movement, the state is that the tip of the blade (25) passes through the cutaway portion of the ring-like piston (23) from the internal peripheral side of the cylinder (C1, C2) to constantly be in contact with the wall surface on the external peripheral side of the cylinder chamber (C1, C2).

When the blade (25) is in the second state, the external side cylinder chamber (C1) is placed in the form of an undivided single space while only the internal side cylinder chamber (C2) is divided into the low pressure chamber (C2-Lp) and the high pressure chamber (C2-Hp). Accordingly, the compression of fluid is carried out only in the internal side cylinder chamber (C2). This results in the second state being lower in compression capability than the first state. As just described above, only by causing the single blade (25) to move backward/forward from the internal peripheral side of the cylinder chamber (C1, C2), the external side cylinder chamber (C1) is placed in the form of an undivided single space, and the volume control is accomplished.

The present invention provides a third aspect according to the first aspect in which the ring-like piston (23) is C-shaped to have a cutaway portion through which the blade (25) is allowed to pass and the blade (25) is inserted advanceably/retractably along the radial direction of the cylinder (21) into a blade groove (26) formed within a wall on the external peripheral side of the cylinder chamber (C1, C2). On the other hand, the blade (25) moves backward/forward to enter either (i) a first state in which the tip of the blade (25) is in sliding contact with a wall surface on the internal peripheral side of the cylinder chamber (C1, C2), thereby dividing the external side cylinder chamber (C1) into the high pressure chamber (C1-Hp) and the low pressure chamber (C1-Lp) and the internal side cylinder chamber (C2) into the high pressure chamber (C2-Hp) and the low pressure chamber (C1-Lp) or (ii) a second state in which the tip of the blade (25) is positioned in the cutaway portion of the ring-like piston (23), thereby placing only the internal side cylinder chamber (C2) in the form of an undivided single space.

In the third aspect of the present invention, for example, if, when the blade (25) is in the first state, the cylinder (21) and the ring-like piston (23) move relatively in an eccentric rotation motion, the compression of fluid is carried out in each cylinder chamber (C1, C2). That is, in one rotational movement, the state is that the tip of the blade (25) passes through the cutaway portion of the ring-like piston (23) from the external peripheral side of the cylinder (C1, C2) to constantly be in contact with the wall surface on the internal peripheral side of the cylinder chamber (C1, C2).

When the blade (25) is in the second state, the internal side cylinder chamber (C2) is placed in the form of an undivided single space while only the external side cylinder chamber (C1) is divided into the low pressure chamber (C1-Lp) and the high pressure chamber (C1-Hp). Accordingly, the compression of fluid is carried out only in the external side cylinder chamber (C1). This results in the second state being lower in compression capability than the first state. As just described above, only by causing the single blade (25) to move backward/forward from the external peripheral side of the cylinder chamber (C1, C2), the internal side cylinder chamber (CZ) is placed in the form of an undivided single space, and the volume control is accomplished.

The present invention provides a fourth aspect according to either the second or the third aspect in which the blade (25) moves backward/forward to enter a third state in which the tip of the blade (25) is positioned in the blade groove (26), thereby placing the external side cylinder chamber (C1) and the internal side cylinder chamber (C2) in the form of respective undivided single spaces.

In the fourth aspect of the present invention, the external side cylinder chamber (C1) and the internal side cylinder chamber (C2) are each placed in the form of a respective undivided single space, and the compression of fluid is not carried out at all. Accordingly, the third state is the state in which the volume of compression becomes zero without drive shutdown.

The present invention provides a fifth aspect which includes (i) a cylinder (21) having an internal side cylinder part (21*b*) and an external side cylinder part (21*a*), the internal side cylinder part (21*b*) and the external side cylinder part (21*a*) defining an internal side cylinder chamber (C3) and an external side, ring-like cylinder chamber (C1, C2), (ii) a piston (17) having an internal piston part (24) which is accommodated in the internal side cylinder chamber (C3) and an external piston part (23) which is accommodated in the ring-like cylinder chamber (C1, C2) to thereby divide the ring-like cylinder chamber (C1, C2) into an external side cylinder chamber (C1) and an intermediate cylinder chamber (C2), the internal piston part (24) and the external piston part (23) together being eccentric relative to the cylinder (21), and (iii) a blade (25) which divides the internal side cylinder chamber (C3) into a high pressure chamber (C3-Hp) and a low pressure chamber (C3-Lp), the intermediate cylinder chamber (C2) into a high pressure chamber (C2-Hp) and a low pressure chamber (C2-Lp), and the external side cylinder chamber (C1) into a high pressure chamber (C1-Hp) and a low pressure chamber (C1-Lp), wherein the cylinder (21) and the piston (17) are configured such that they move relatively in an eccentric rotation motion. On the other hand, the blade (25) is configured to be advanceable/retractable in the length direction thereof so that during one rotational movement, at least either one of the internal side cylinder chamber (C3) and the external side cylinder chamber (C1) is placed in the form of an undivided single space.

In the fifth aspect of the present invention, for example, if, when the external side cylinder chamber (C1), the intermediate cylinder chamber (C2), the internal side cylinder chamber (C3) are divided by the blade (25) into the high pressure chambers (C1-Hp, C2-Hp, C3-Hp) and the low pressure chambers (C1-Lp, C2-Lp, C3-Lp), the cylinder (21) and the piston (17) move relatively in an eccentric rotation motion, fluid is drawn into the low pressure chambers (C1-Lp, C2-Lp, C3-Lp) while fluid is compressed in the high pressure chambers (C1-Hp, C2-Hp, C3-Hp), in the cylinder chambers (C1, C2, C3).

Here, for example, if the blade (25) moves backward/forward so that the external side cylinder chamber (C1) is placed in the form of an undivided single space, the external side cylinder chamber (C1) is not divided into the high pressure chamber (C1-Hp) and the low pressure chamber (C1-Lp). That is, the compression of fluid is not carried out in the external side cylinder chamber (C1). Accordingly, the compression of fluid is carried out only in the intermediate cylinder chamber (C2) and the internal side cylinder chamber (C3), and the volume of compression decreases. If, in addition to the external side cylinder chamber (C1), the intermediate cylinder chamber (C2) is placed in the form of an undivided single space, this reduces the volume of compression to a further extent. The same is true for the case where only the internal side cylinder chamber (C3) is placed in the form of an undivided single space as well as for the case where, in addition to the internal side cylinder chamber (C3), the intermediate cylinder chamber (C2) is placed in the form of an undivided single space. In the way as described above, the volume control becomes possible by placing each cylinder chamber (C1, C2) in the form of an undivided single space.

The present invention provides a sixth aspect according to the fifth aspect in which the external piston part (23) and the internal side cylinder part (21*b*) are each C-shaped to have a respective cutaway through which the blade (25) is allowed to pass. And the blade (25) is formed by a blade (25) of a single body which is inserted advanceably/retractably in the radial direction of the internal piston part (24) into a blade groove (26) formed in the internal piston part (24). On the other hand, the blade (25) moves backward/forward to enter either (i) a first state in which the tip of the blade (25) is in sliding contact with the internal peripheral surface of the external side cylinder part (21*a*), thereby dividing the external side cylinder chamber (C1) into the high pressure chamber (C1-Hp) and the low pressure chamber (C1-Lp), the intermediate cylinder chamber (C2) into the high pressure chamber (C2-Hp) and the low pressure chamber (C2-Lp), and the internal side cylinder chamber (C3) into the high pressure chamber (C3-Hp) and the low pressure chamber (C3-Lp), (ii) a second state in which the tip of the blade (25) is positioned in the cutaway portion of the external piston part (23), thereby placing only the external side cylinder chamber (C1) in the form of an undivided single space, or (iii) a third state in which the tip of the blade (25) is positioned in the cutaway portion of the internal side cylinder part (21*b*), thereby placing only the external side cylinder chamber (C1) and the intermediate cylinder chamber (C2) in the form of respective undivided single spaces.

In the sixth aspect of the present invention, for example, if, when the blade (25) is in the first state, the cylinder (21) and the piston (17) move relatively in an eccentric rotation motion, the compression of fluid is carried out in each of the cylinder chambers (C1, C2, C3). In other word, during one rotational movement, the blade (25) is in such a state that the tip thereof passes in sequence through the cutaway portion of the internal side cylinder part (21*b*) and then through the cutaway portion of the external piston part (23) from the internal piston part (24) to come into contact with the internal peripheral surface of the external side cylinder part (21*a*).

When the blade (25) is in the second state, only the intermediate cylinder chamber (C2) and the internal side cylinder chamber (C3) are subjected to division. More specifically, the intermediate cylinder chamber (C2) is divided into the low pressure chamber (C2-Lp) and the high pressure chamber (C2-Hp) and the internal side cylinder chamber (C3) is divided into the low pressure chamber (C3-Lp) and the high pressure chamber (C3-Hp), and the compression of fluid is carried out. This results in the second state being lower in compression capability than the first state. When the blade (25) is in the third state, only the internal side cylinder chamber (C3) is divided into the low pressure chamber (C3-Lp) and the high pressure chamber (C3-Hp), and the compression of fluid is carried out. This results in the third state being lower in compression capability than the second state. As just described above, by causing the single blade (25) to move backward/forward from the internal piston part (24), it is ensured that the external side cylinder chamber (C1) and the intermediate cylinder chamber (C2) are placed in the form of respective undivided single spaces, and the volume control is accomplished.

The present invention provides a seventh aspect according to the fifth aspect in which the external piston part (23) and the internal side cylinder part (21*b*) are each C-shaped to have a respective cutaway portion through which the blade (25) is allowed to pass. And the blade (25) is formed by a blade (25) of a single body which is inserted advanceably/retractably in the radial direction of the external side cylinder part (21*a*) into a blade groove (26) formed in the external side cylinder part (21*a*). On the other hand, the blade (25) moves backward/forward to enter either (i) a first state in which the tip of the blade (25) is in sliding contact with the external peripheral surface of the internal piston part (24), thereby dividing the external side cylinder chamber (C1) into the high pressure chamber (C1-Hp) and the low pressure chamber (C1-Lp), the intermediate cylinder chamber (C2) into the high pressure chamber (C2-Hp) and the low pressure chamber (C2-Lp), and the internal side cylinder chamber (C3) into the high pressure chamber (C3-Hp) and the low pressure chamber (C3-Lp), (ii) a second state in which the tip of the blade (25) is positioned in the cutaway portion of the internal side cylinder part (21*b*), thereby placing only the internal side cylinder chamber (C3) in the form of an undivided single space, or (iii) a third state in which the tip of the blade (25) is positioned in the cutaway portion of the external piston part (23), thereby placing only the internal side cylinder chamber (C3) and the intermediate cylinder chamber (C2) in the form of respective undivided single spaces.

In the seventh aspect of the present invention, for example, if, when the blade (25) is in the first state, the cylinder (21) and the piston (17) move relatively in an eccentric rotation motion, the compression of fluid is carried out in each cylinder chamber (C1, C2, C3). In other word, during one rotational movement, the blade (25) is in such a state that the tip thereof passes in sequence through the cutaway portion of the external piston part (23) and then through the cutaway portion of the internal side cylinder part (21*b*) from the external side cylinder part (21*a*) to come into contact with the external peripheral surface of the internal piston part (24).

When the blade (25) is in the second state, only the external side cylinder chamber (C1) and the intermediate cylinder chamber (C2) are subjected to division. More specifically, the external side cylinder chamber (C1) is divided into the low pressure chamber (C1-Lp) and the high pressure chamber (C1-Hp) and the intermediate cylinder chamber (C2) is divided into the low pressure chamber (C2-Lp) and the high pressure chamber (C2-Hp), and the compression of fluid is carried out. This results in the second state being lower in compression capability than the first state. When the blade (25) is in the third state, only the external side cylinder chamber (C1) is divided into the low pressure chamber (C1-Lp) and the high pressure chamber (C1-Hp), and the compression of fluid is carried out. This results in the third state being lower in compression capability than the second state. As just described above, by causing the single blade (25) to move backward/forward from the external side cylinder part (21*a*), it is ensured that the internal side cylinder chamber (C3) and the intermediate cylinder chamber (C2) are placed in the form of respective undivided single spaces, and the volume control is accomplished.

The present invention provides an eighth aspect according to either the sixth or the seventh aspect in which the blade (25) moves backward/forward to enter a fourth state in which the tip of the blade (25) is positioned in the blade groove (26), thereby placing the external side cylinder chamber (C1), the intermediate cylinder chamber (C2), and the internal side cylinder chamber (C3) in the form of respective undivided single spaces.

In the eighth aspect of the present invention, since the external side cylinder chamber (C1), the intermediate cylinder chamber (C2), and the internal side cylinder chamber (C3) are each placed in the form of a respective undivided single space, the compression of fluid is not carried out at all. Accordingly, the fourth state is the state in which the volume of compression becomes zero without drive shutdown.

The present invention provides a ninth aspect according to the fifth aspect in which the blade (25) is made up of (i) an internal side blade member (25*a*) formed integrally with the external piston part (23) and the internal piston part (24) and passing through the internal side cylinder part (21*b*) to thereby divide the intermediate cylinder chamber (C2) into the high pressure chamber (C2-Hp) and the low pressure chamber (C2-Lp) and the internal side cylinder chamber (C3) into the high pressure chamber (C3-Hp) and the low pressure chamber (C3-Lp) and (ii) an external side blade member (25*b*) inserted advanceably/retractably in the radial direction of the external side cylinder part (21*a*) into a blade groove (26) formed in the external side cylinder part (21*a*) to thereby divide the external side cylinder chamber (C1) into the high pressure chamber (C1-Hp) and the low pressure chamber (C1-Lp). And the external side blade member (25*b*) moves backward/forward to enter either (i) a first state in which the tip of the external side blade member (25*b*) is in sliding contact with the external peripheral surface of the external piston part (23), thereby dividing the external side cylinder chamber (C1) into the high pressure chamber (C1-Hp) and the low pressure chamber (C1-Lp) or (ii) a second state in which the tip of the external side blade member (25*b*) moves away from the external peripheral surface of the external piston part (23), thereby placing the external side cylinder chamber (C1) in the form of an undivided single space.

In the ninth aspect of the present invention, in the first state, the compression of fluid is carried out in all of the external side cylinder chamber (C1), the intermediate cylinder chamber (C2), and the internal side cylinder chamber (C3). On the other hand, in the second state, the compression of fluid is carried out only in the intermediate cylinder chamber (C2) and the internal side cylinder chamber (C3). This results in the second state being lower in compression capability than the first state.

The present invention provides a tenth aspect according to the fifth aspect in which the blade (25) is made up of (i) an external side blade member (25*b*) formed integrally with the external piston part (23) and the internal piston part (24) and passing through the external piston part (23) to thereby divide the external side cylinder chamber (C1) into the high pressure chamber (C1-Hp) and the low pressure chamber (C1-Lp) and the intermediate cylinder chamber (C2) into the high pressure chamber (C2-Hp) and the low pressure chamber (C2-Lp) and (ii) an internal side blade member (25*a*) inserted advanceably/retractably in the radial direction of the internal piston part (24) into a blade groove (26) formed in the internal piston part (24) to thereby divide the internal side cylinder chamber (C3) into the high pressure chamber (C3-Hp) and the low pressure chamber (C3-Lp). And, the internal side blade member (25*a*) moves backward/forward to enter either (i) a first state in which the tip of the internal side blade member (25*a*) is in sliding contact with the internal peripheral surface of the internal side cylinder part (25), thereby dividing the internal side cylinder chamber (C3) into the high pressure chamber (C3-Hp) and the low pressure chamber (C3-Lp) or (ii) a second state in which the tip of the internal side blade member (25*a*) moves away from the internal peripheral surface of the internal side cylinder part (25), thereby placing the internal side cylinder chamber (C3) in the form of an undivided single space.

In the tenth aspect of the present invention, in the first state, the compression of fluid is carried out in all of the external side cylinder chamber (C1), the intermediate cylinder chamber (C2), and the internal side cylinder chamber (C3). On the other hand, in the second state, the compression of fluid is carried out only in the external side cylinder chamber (C1) and the intermediate cylinder chamber (C2). This results in the second state being lower in compression capability than the first state.

Advantageous Effects of the Invention

Therefore, in accordance with the first aspect of the present invention, it is configured that with respect to the two cylinder chambers (C1, C2) defined in the radial direction of the cylinder (21), the blade (25) is passed through the ring-like piston (23) to move backward/forward so that at least one cylinder chamber is placed in the form of an undivided single space, thereby making it possible that the volume control is accomplished.

In addition, in accordance with the fifth aspect of the present invention, it is configured that with respect to the three cylinder chambers (C1, C2, C3) defined in the radial direction of the cylinder (21), the blade (25) is passed through the external piston part (23) and through the internal side cylinder part (21*b*) to move backward/forward so that at least one cylinder chamber is placed in the form of an undivided single space, thereby making it possible that the volume control is accomplished.

In addition, in accordance with the second or the sixth aspect of the present invention, it is configured that the blade (25) is moved backward/forward from the internal peripheral side of the cylinder chambers (C1, C2), and in accordance with the third or the seventh aspect of the present invention, it is configured that the blade (25) is moved backward/forward from the external peripheral side of the cylinder chambers (C1, C2). This ensures that each cylinder chamber (C1, C2) defined in the radial direction can be either divided into the high pressure chamber (C1-Hp, . . . ) and the low pressure chamber (C1-Lp, . . . ) or placed in the form of a respective undivided single space.

In addition, in accordance with the fourth or the eighth aspect of the present invention, all of the cylinder chambers (C1, . . . ) can be placed in the form of respective undivided single spaces, whereby the volume of compression can be made zero without drive shutdown of the equipment. Accordingly, for example, in the case where the equipment is frequently repeatedly started and stopped, it is possible to control the cost of electricity due to the starting current.

DETAILED DESCRIPTION OF THE INVENTION

In the following, preferred embodiments of the present invention will be described in detail with reference to the drawings.

First Embodiment of the Invention

Figure 1:
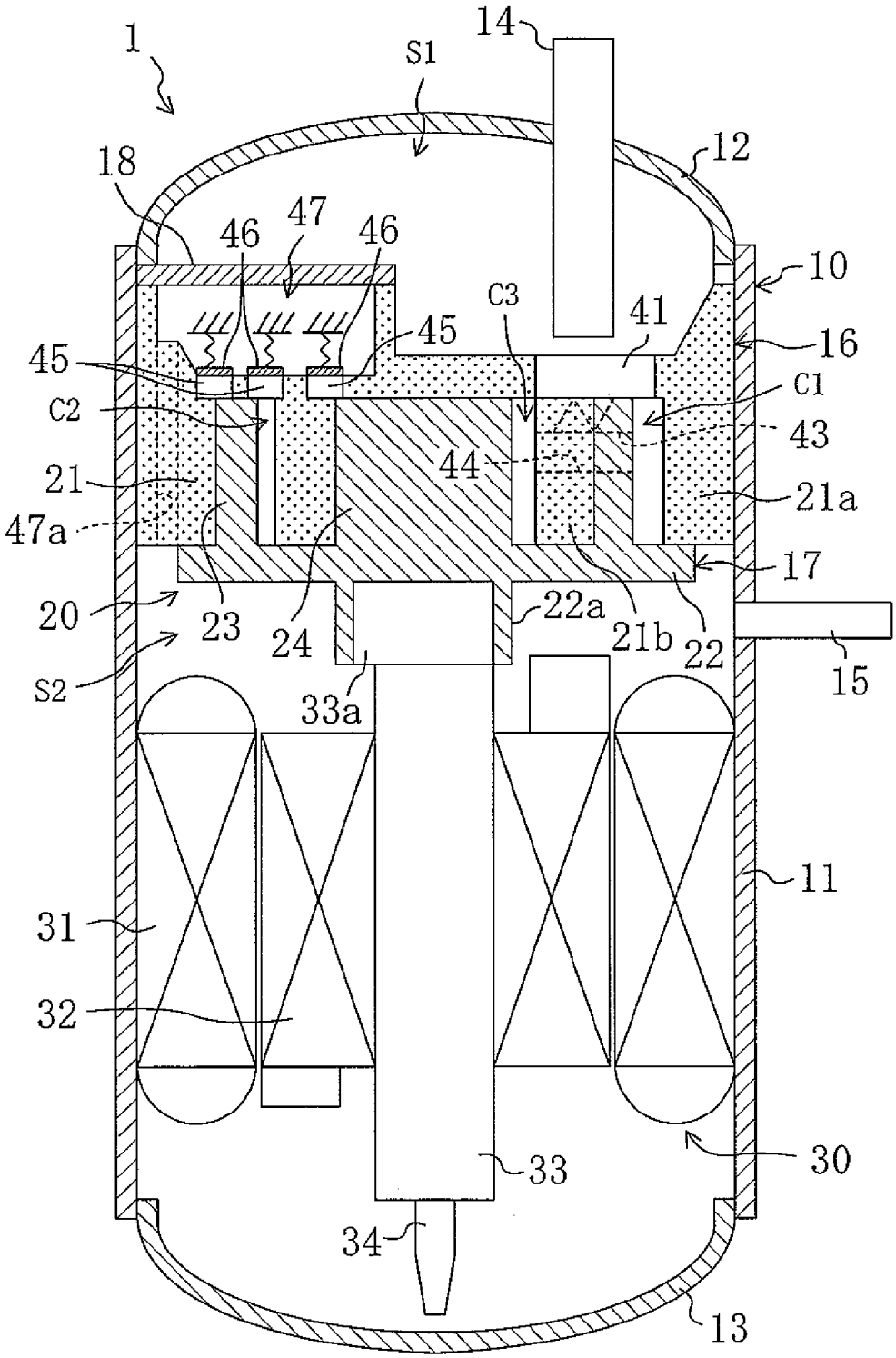
FIG. 1 is a longitudinal cross-sectional view illustrating a compressor according to a first embodiment of the present invention.

A first embodiment of the present invention is concerned with a compressor of the rotary type. As shown in FIG. 1, a compressor (1) of the first embodiment contains, in a casing (10) thereof, a compression mechanism (20) and an electric motor (30) which is a drive mechanism. The compressor (1) is configured into a hermetical type. The compressor (1) is used, for example, in the refrigerant circuit of an air conditioning system to compress refrigerant drawn in from an evaporator and then discharge it to a condenser.

The casing (10) is composed of a side body part (11) having a circular tube shape, an upper end plate (12) firmly secured to the top end part of the side body part (11), and a lower end plate (13) firmly secured to the bottom end part of the side body part (11). A suction pipe (14) is provided which passes through the upper end plate (12). A discharge pipe (15) is provided which passes through the side body part (11).

The compression mechanism (20) has a housing (16) and an eccentric rotation part (17). The compression mechanism (20) constitutes an eccentric rotary type piston mechanism. The housing (16) is firmly secured to the side body part (11) of the casing (10) and has a cylinder (21). The housing (16) has a piston (23, 24) arranged within the cylinder (21) and is configured such that it moves in an eccentric rotation motion with respect to the cylinder (21). In other words, in the present first embodiment, the cylinder (21) is a fixed side while on the other hand the piston (23, 24) is a movable side. The compression mechanism (20) will be described later in detail.

The electric motor (30) has a stator (31) and a rotor (32). The stator (31) is disposed below the compression mechanism (20) and is firmly secured to the side body part (11) of the casing (10). Connected to the rotor (32) is a drive shaft (33) which rotates along with the rotor (32). The drive shaft (33) extends in an up and down direction and has, at its top end part, an eccentric part (33*a*) connected to the eccentric rotation part (17). The eccentric part (33*a*) is formed such that it has a greater diameter than the rest of the drive shaft (33) and is off-centered from the axial center of the drive shaft (33) by a given amount.

Formed in the drive shaft (33) is an oil feeding path (not diagrammatically shown) extending in the axial direction thereof. In addition, an oil feeding pump (34) is provided at the bottom end part of the drive shaft (33). The oil feeding pump (34) is configured such that it pumps up lubricant collected on the bottom of the casing (10) and supplies it to sliding parts of the compression mechanism (20) through the oil feeding path of the drive shaft (33).

The cylinder (21) is formed integrally with the housing (16) and has an external side cylinder part (21*a*) and an internal side cylinder part (21*b*). The external side cylinder part (21*a*) and the internal side cylinder part (21*b*) are formed into respective circular ring shapes which are coaxial with each other. And a cylinder chamber (C1, C2) having a ring shape is defined between the internal peripheral surface of the external side cylinder part (21*a*) and the external peripheral surface of the internal side cylinder part (21*b*), and there is defined within the internal side cylinder part (21*b*) a cylinder chamber of circular shape.

The eccentric rotation part (17) has an end plate (22), a ring-like piston (23) serving as an external piston, and a circular cylinder-like piston (24) serving as an internal piston, wherein the pistons (23, 24) are formed standingly integrally to the top surface of the end plate (22). The ring-like piston (23) is formed such that its inside diameter is greater than the outside diameter of the circular cylinder-like piston (24). In addition, the ring-like piston (23) is formed such that it is coaxial with the circular cylinder-like piston (24). And the eccentric rotation part (17) is configured such that the ring-like piston (23) is disposed within the ring-like cylinder chamber (C1, C2) to thereby divide the cylinder chamber (C1, C2) into an external side cylinder chamber (C1) and an intermediate cylinder chamber (C2) while the circular cylinder-like piston (24) is disposed in the internal side cylinder part (21*b*) to thereby define an internal side cylinder chamber (C3).

To sum up the above, the external side cylinder chamber (C1) is defined, as a first cylinder chamber, between the internal peripheral surface of the external side cylinder part (21*a*) and the external peripheral surface of the ring-like piston (23); the intermediate cylinder chamber (C2) is defined, as a second cylinder chamber, between the internal peripheral surface of the ring-like piston (23) and the external peripheral surface of the internal side cylinder part (21*b*); and the internal side cylinder chamber (C3) is defined, as a third cylinder chamber, between the internal peripheral surface of the internal side cylinder part (21*b*) and the external peripheral surface of the circular cylinder-like piston (24). As just described, in the compression mechanism (20) of the present embodiment, the three cylinder chambers (C1, C2, C3) are defined in the radial direction of the cylinder (21).

The ring-like piston (23) is formed such that its external peripheral surface substantially comes into contact with the internal peripheral surface of the external side cylinder part (21*a*) at one point while, at a position which differs in phase by 180 degrees from that contact point, its internal peripheral surface substantially comes into contact with the external peripheral surface of the internal side cylinder part (21*b*) at one point. On the other hand, the circular cylinder-like piston (24) is formed such that at a position in the same phase as the point of contact between the ring-like piston (23) and the external side cylinder part (21*a*), its external peripheral surface substantially comes into contact with the internal peripheral surface of the internal side cylinder part (21*b*).

The eccentric rotation part (17) integrally has, in the bottom surface of the end plate (22), an engagement part (22*a*) for engagement with the drive shaft (33). The engagement part (22*a*) is formed in a circular tube shape which is coaxial with the ring-like piston (23) and the circular cylinder-like piston (24). The eccentric part (33*a*) of the drive shaft (33) is rotatably engaged into the engagement part (22) for coupling therebetween.

Figure 2:
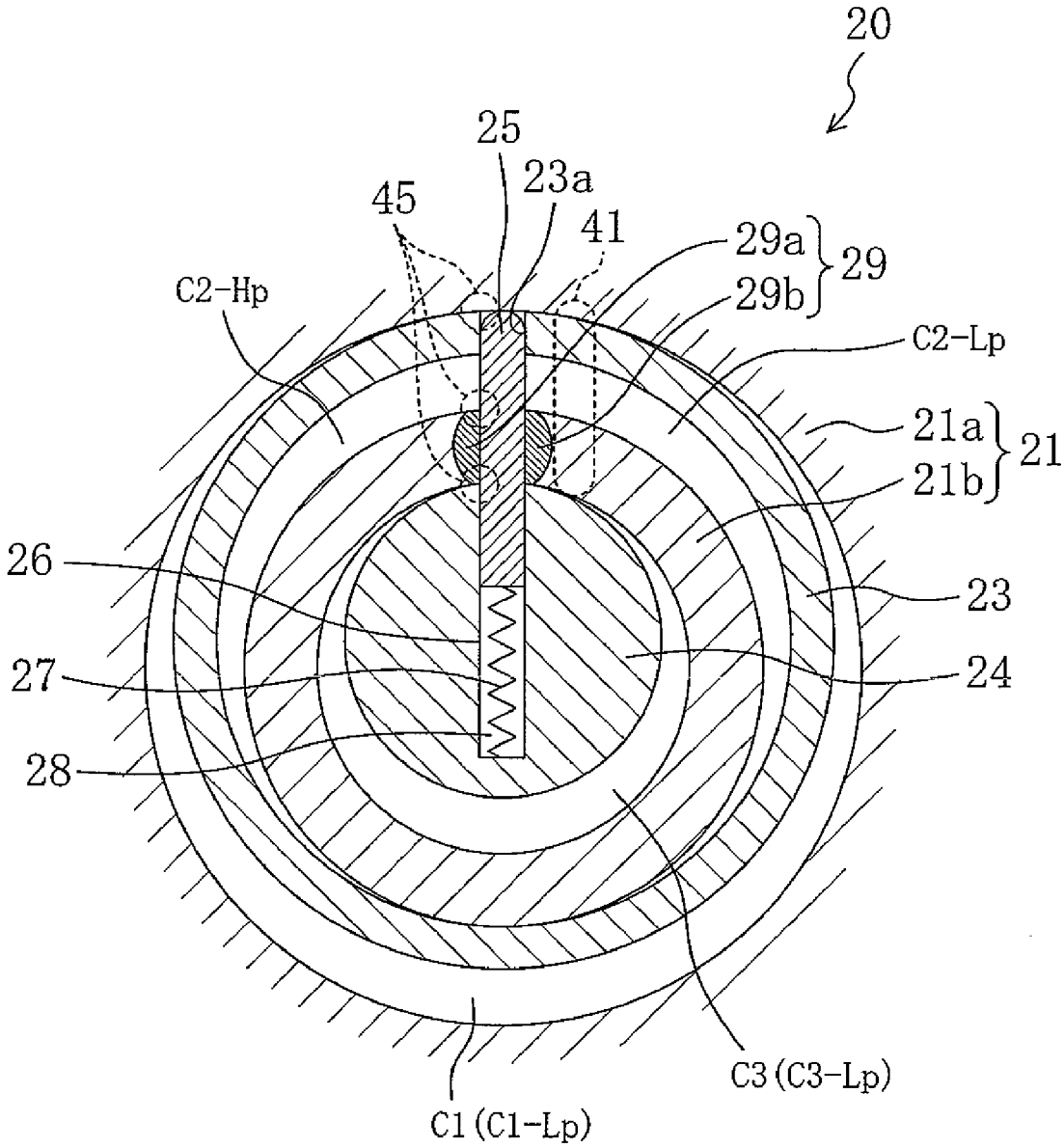
FIG. 2 is a transverse cross-sectional view illustrating a compression mechanism of the first embodiment.

As shown in FIG. 2, the circular cylinder-like piston (24) is provided with a blade groove (26) extending along the radial direction of the circular cylinder-like piston (24). A blade (25) having an oblong plate shape is inserted advanceably/retractably and slidably along the radial direction of the circular cylinder-like piston (24) into the blade groove (26). Mounted within a blade back chamber (28) of the blade groove (26) is a spring (27) by which the blade (25) is biased outwardly in the radial direction of the circular cylinder-like piston (24). And the blade (25) is configured such that it can divide each cylinder chamber (C1, C2, C3) into a high pressure chamber (C1-Hp, C2-Hp, C3. Hp) as a first chamber which is a compression chamber and a low pressure chamber (C1-Lp, C2-Lp, C3-Lp) as a second chamber which is a suction chamber.

The internal side cylinder part (21*b*) is formed in a C-shaped configuration, i.e., a ring shape with a cutaway portion. Mounted in the cutaway portion of the internal side cylinder part (21*b*) is a swinging bush (29) through which the blade (25) is inserted. The swinging bush (29) is composed of a discharge side bush (29*a*) and a suction side bush (29*b*). With respect to the blade (25), the discharge side bush (29*a*) and the suction side bush (29*b*) are positioned, respectively, on the side of the high pressure chambers (C1-Hp, C2-Hp) and on the side of the low pressure chambers (C1-Lp, C2-Lp).

The discharge side bush (29*a*) and the suction side bush (29*b*) each have an approximate semicircle shape in cross section and their flat surfaces are arranged to lie face to face with each other. That is, the blade (25) is inserted through between the opposing surfaces of the swinging bush (29) while being in sliding contact therewith. In addition, the swinging bush (29) is configured such that it swings together with the blade (25) with respect to the internal side cylinder part (21*b*). Also note that both the bushes (29*a*) and (29*b*) may not be formed separately from each other, in other word they may be of an integral structure having a coupling part.

The ring-like piston (23) is formed in a C-shaped configuration, i.e., a ring shape with a cutaway portion. The cutaway portion of the ring-like piston (23) constitutes a blade insertion part (23*a*) through which the blade (25) is inserted while being in sliding contact therewith.

In the compression mechanism (20), with rotation of the drive shaft (33), the point of contact between the ring-like piston (23) and the external side cylinder part (21*a*), the point of contact between the ring-like piston (23) and the internal side cylinder part (21*b*), and the point of contact between the circular cylinder-like piston (24) and the internal side cylinder part (21*b*) shift, for example, from FIG. 4(A) to FIG. 4(D). In other words, the compression mechanism (20) is configured such that as the drive shaft (33) rotates, the ring-like piston (23) and the circular cylinder-like piston (24) do not rotate, but orbit around the drive shaft (33).

In addition, the compression mechanism (20) is configured such that the cylinder chambers (C1, C2, C3) which are divided by the blade (25) into the high pressure chambers (C1-Hp, . . . ) and the low pressure chambers (C1-Lp, . . . ) are made variable in numeric quantity, which is a feature of the present invention. That is, the blade (25) is movable to switch among four different states, namely a first state in which all of the three cylinder chambers (C1, C2, C3) are subjected to division, a second state in which only the intermediate cylinder chamber (C2) and the internal side cylinder chamber (C3) are subjected to division, a third state in which only the internal side cylinder chamber (C3) is subjected to division, and a fourth state (whole rest state) in which none of the three cylinder chambers (C1, C2, C3) are subjected to division.

That is, the blade (25) is configured to freely advance and retract to enter either (i) the first state in which the tip is constantly in sliding contact with the internal peripheral surface of the external side cylinder part (21*a*), (ii) the second state in which the tip is positioned in the blade insertion part (23*a*) of the ring-like piston (23) thereby placing only the external side cylinder chamber (C1) in the form of an undivided single space, (iii) the third state in which the tip is positioned in the swinging bush (29) of the internal side cylinder part (21*b*) thereby placing only the external side cylinder chamber (C1) and the intermediate cylinder chamber (C2) in the form of respective undivided single spaces, or (iv) the whole rest state in which the tip is positioned in the blade groove (26) thereby placing the external side cylinder chamber (C1), the intermediate cylinder chamber (C2), and the internal side cylinder chamber (C3) in the form of respective undivided single spaces.

As shown in FIG. 3, a working chamber (51) for movement is provided in the inside of the blade (25). The movement working chamber (51) is positioned centrally relative to the thickness direction of the blade (25) (i.e., the up and down direction in FIG. 3) and its cross section is formed in a long hole shape extending in the width direction of the blade (25) (i.e., the horizontal direction in FIG. 3). And the movement working chamber (51) extends along the length direction of the blade (25) (i.e., the paper surface direction in FIG. 3). The movement working chamber (51) contains therein a partition pin (54) which is a part of the circular cylinder-like piston (24). The partition pin (54) is shaped like a circular cylinder extending in the length direction of the blade (25) and is configured such that it divides the movement working chamber (51) into a front end side chamber (52) and a rear end side chamber (53).

A working chamber (56) for fixation which opens to the blade groove (26) is provided in the inside of the circular cylinder-like piston (24). The fixation working chamber (56) contains therein a piston (57) for fixation and a spring (58).

The fixation piston (57) is shaped like a rectangular body and is inserted advanceably/retractably and slidably into the fixation working chamber (56). The spring (58) is mounted in a back chamber (59) of the fixation working chamber (56) and pulls the fixation piston (57) towards the back chamber (59).

The blade (25) is provided, in its one side surface, with three fixation holes (55*a*, 55*b*, 55*c*). These fixation holes (55*a*, 55*b*, 55*c*) are arranged side by side at predetermined intervals at each other in the width direction of the blade (25). The first fixation hole (55*a*), the second fixation hole (55*b*), and the third fixation hole (55*c*) are formed in that order from the front end side to the rear end side of the blade (25). Each of the fixation holes (55*a*, 55*b*, 55*c*) is formed such that it has a shape and a size capable of engagement with the fixation piston (57) of the fixation working chamber (56). By engagement with the fixation piston (57), the blade (25) is made stationary relative to the circular cylinder-like piston (24) and the ring-like piston (23).

The first fixation hole (55*a*) is formed at a position where the blade (25) is placed in the whole rest state, with the fixation piston (57) in engagement therewith. That is, in the whole rest state, the entire blade (25) is accommodated in the blade groove (26), whereby none of the cylinder chambers (C1, C2, C3) are subjected to division by the blade (25).

The second fixation hole (55*b*) is formed at a position where the blade (25) is placed in the third state, with the fixation piston (57) in engagement therewith. That is, in the third state, the compression of refrigerant is carried out only in the internal side cylinder chamber (C3). Also note that it is arranged in the third state such that the tip of the blade (25) is constantly positioned outside the center of the swinging bush (29). Consequently, it becomes possible to prevent load from being concentrically applied to one side in the flat part of the swinging bush (29), thereby making it possible to stabilize the behavior of the swinging bush (29).

The third fixation hole (55*c*) is formed at a position where the blade (25) is placed in the second state, with the fixation piston (57) in engagement therewith. That is, in the second state, the compression of refrigerant is carried out only in the intermediate cylinder chamber (C2) and the internal side cylinder chamber (C3).

In addition, when the fixation piston (57) is in engagement with none of the fixation holes (55*a*, 55*b*, 55*c*) in the compression mechanism (20), the blade (25) is allowed to freely move backward/forward with respect to the blade groove (26) and enters the first state. Stated another way, in the first state, the compression of refrigerant is carried out in all of the cylinder chambers (C1, C2, C3).

The blade back chamber (28) of the blade groove (26) is configured such that it is switchable between two different states, namely, a high pressure state in which a pressure P1 is applied and a low pressure state in which the pressure P1 is not applied. In other words, when the blade back chamber (28) changes its state to the high pressure state, the blade (25) is biased radially outwardly by the spring (27) and high pressure.

The movement working chamber (51) of the blade (25) is configured such that it is switchable among three different states, namely, a first state in which a pressure P2 is applied to the front end side chamber (52), a second state in which the pressure P2 is applied to the rear end side chamber (53), and a third state in which the pressure P2 is applied to none of the front end side chamber (52) and the rear end side chamber (53). In other words, when the movement working chamber (51) is switched to either the first or the second state, the blade (25) is made to slide radially outwardly or radially inwardly by the difference in pressure occurring between the front end side chamber (52) and the rear end side chamber (53).

The back chamber (59) of the fixation working chamber (56) is configured such that it is switchable between a high pressure state in which a pressure P3 is applied and a low pressure state in which the pressure P3 is not applied. In other words, when the back chamber (59) changes its state to the high pressure state, the fixation piston (57) is made to slide to the blade groove (26) by the pressure P3 while on the other hand when the back chamber (59) changes its state to the low pressure state, the fixation piston (57) is accommodated within the fixation working chamber (56) by tension of the spring (58). Also note that the high pressure of a high pressure space (S2) (to be hereinafter described) within the casing (10) may be utilized as the pressures P1-P3. Alternatively, the pressure of a high pressure part in an external refrigerant piping line may be utilized.

Figure 3A:
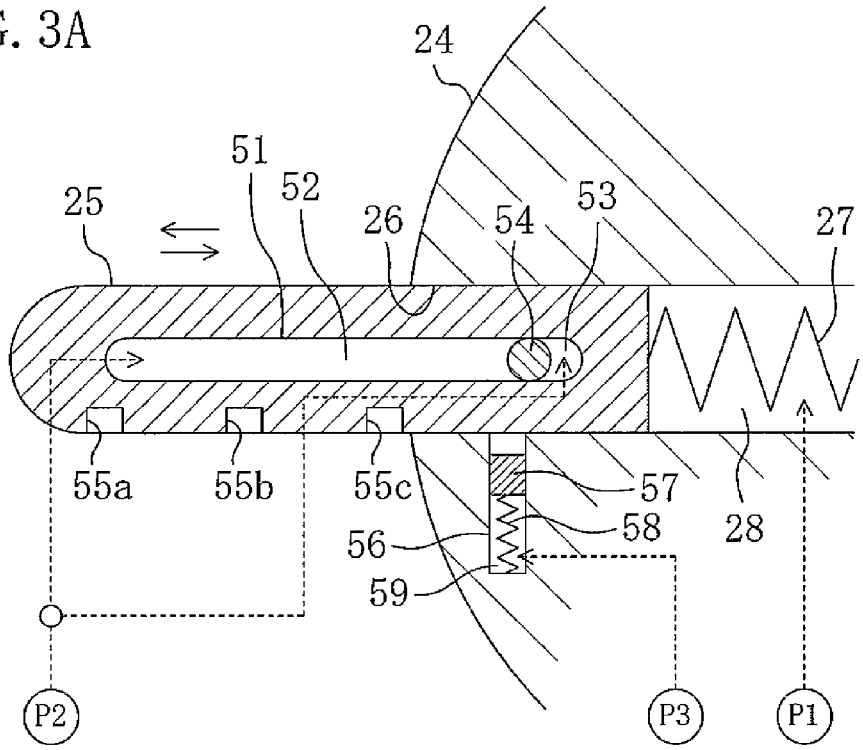
FIG. 3 is a transverse cross-sectional view illustrating an essential part of the compression mechanism of the first embodiment.

For the case of the first state in the compression mechanism (20), the blade (25) is not made stationary by the fixation piston (57) (see FIG. 3(A)), thereby allowing the blade (25) to move backward/forward with respect to the blade (26) so that the tip of the blade (25) is constantly in contact with the internal peripheral surface of the external side cylinder part (21*a*) (see FIG. 4). In the first state, the compression of refrigerant is carried out in each of the three cylinder chambers (C1, C2, C3).

Figure 3B:
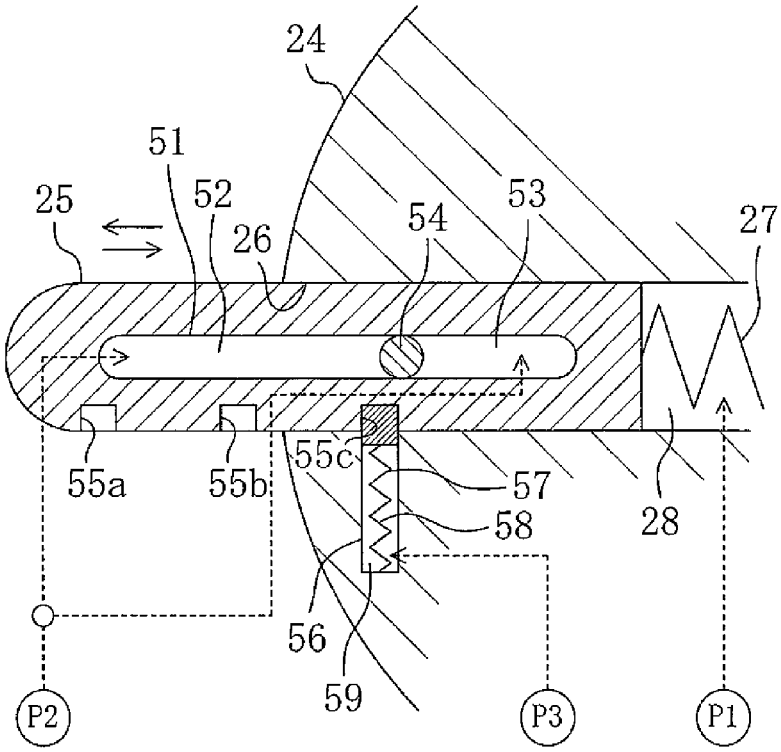

In addition, for the case of the second state in the compression mechanism (20), the fixation piston (57) engages into the third fixation hole (55*c*) of the blade (25) (see FIG. 3(B)), whereby the blade (25) is made stationary without moving backward/forward with respect to the blade groove (26) (see FIG. 5). In the second state, the external side cylinder chamber (C1) is placed at rest and the compression of refrigerant is carried out in each of the intermediate cylinder chamber (C2) and the internal side cylinder chamber (C3).

In addition, for the case of the third state in the compression mechanism (20), the fixation piston (57) engages into the second fixation hole (55*b*) of the blade (25), whereby the blade (25) is made stationary without moving backward/forward with respect to the blade groove (26) (see FIG. 6). In the third state, the external side cylinder chamber (C1) and the intermediate cylinder chamber (C2) are placed at rest and the compression of refrigerant is carried out in the internal side cylinder chamber (C3).

In addition, for the case of the whole rest state in the compression mechanism (20), the fixation piston (57) engages into the first fixation hole (55*a*) of the blade (25), whereby the blade (25) is made stationary without moving backward/forward with respect to the blade groove (26) (see FIG. 7). In the whole rest state, all of the three cylinder chambers (C1, C2, C3) are placed at rest and the compression of refrigerant is not carried out at all.

As described above, the whole rest state is the state in which the volume of compression is zero. For the rest of the states, the volume of compression becomes lower in the order of the first state, the second state, and the third state.

The upper housing (16) is provided, below the suction pipe (14), with a suction port (41) of long hole shape. The suction port (41) runs through the housing (16) in the axial direction thereof and establishes fluid communication between the low pressure chamber (C1-Lp, C2-Lp, C3-Lp) of the cylinder chamber (C1, C2, C3) and a low pressure space (S1) which is an upper space of the housing (16). In addition, the ring-like piston (23) is provided with a through hole (43) for fluid communication between the low pressure chamber (C1-Lp) of the external side cylinder chamber (C1) and the low pressure chamber (C2-Lp) of the intermediate cylinder chamber (C2). The internal side cylinder part (21*b*) is provided with a through hole (44) for fluid communication between the low pressure chamber (C2-Lp) of the intermediate cylinder chamber (C2) and the low pressure chamber (C3-Lp) of the internal side cylinder chamber (C3).

Also note that the upper end parts of the ring-like piston (23) and the internal side cylinder part (21*b*) corresponding to the suction port (41) are each chamfered (as shown in broken line in FIG. 1) into a wedge shape. As a result of such arrangement, the suction of refrigerant into the low pressure chamber (C2-Lp, C3-LP) is carried out effectively.

The housing (16) is provided with three discharge ports (45). Each discharge port (45) runs through the housing (16) in the axial direction thereof. The lower end of each discharge port (45) is opened so that it faces the high pressure chamber (C1-Hp, C2-Hp, C3-Hp) of the cylinder chamber (C1, C2, C3). On the other hand, the upper end of each discharge port (45) fluidly communicates, through a discharge valve (46) which is a reed valve for opening and closing its associated discharge port (45), with a discharge space (47).

The discharge space (47) is defined between the housing (16) and a cover plate (18). The external side cylinder part (21*a*) is provided with a discharge passageway (47*a*) which fluidly communicates with a high pressure space (S2) which is a lower space of the housing (16) from the discharge space (47).

Running Operation

Next, the running operation of the compressor (1) of the first embodiment is described below. Here, the operation of sequential switching from the first state to the second state, then to the third state, and then to the whole rest state and the operation of compression in each of the states are described with reference to FIGS. 4 through 7.

In the first state, the blade back chamber (28), the movement working chamber (51), the back chamber (59) of the fixation working chamber (56) are switched to the high pressure state, to the third state, and to the low pressure state, respectively. When, in the above condition, the electric motor (30) is started, rotation of the rotor (32) is transmitted through the drive shaft (33) to the eccentric rotation part (17). Consequently, as shown in FIG. 4, the ring-like piston (23) and the circular cylinder-like piston (24) orbit while swinging relative to the external side cylinder part (21*a*) and the internal side cylinder part (21*b*), and a given compression operation is carried out. At that time, the blade (25) moves in a backward/forward motion with respect to the blade groove (26) so that the tip of the blade (25) is constantly in contact with the internal peripheral surface of the external side cylinder part (21*a*), while moving in a swing motion together with the swinging bush (29) with respect to the internal side cylinder part (21*b*).

Figure 4A:
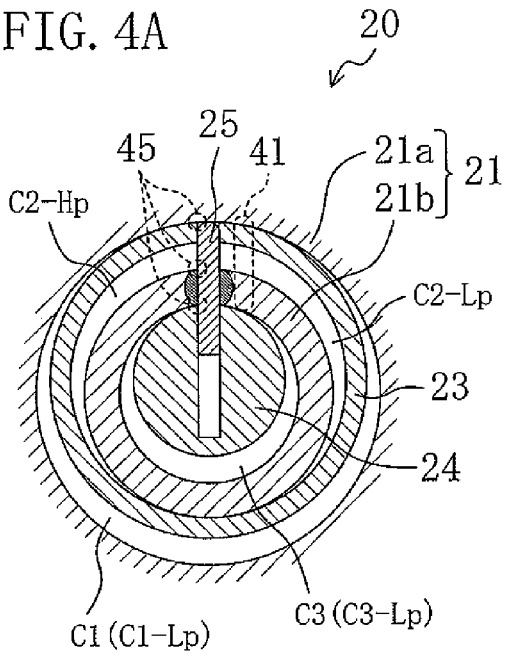
FIG. 4 is a transverse cross-sectional view illustrating how the compression mechanism of the first embodiment operates in a first state.
Figure 4C:
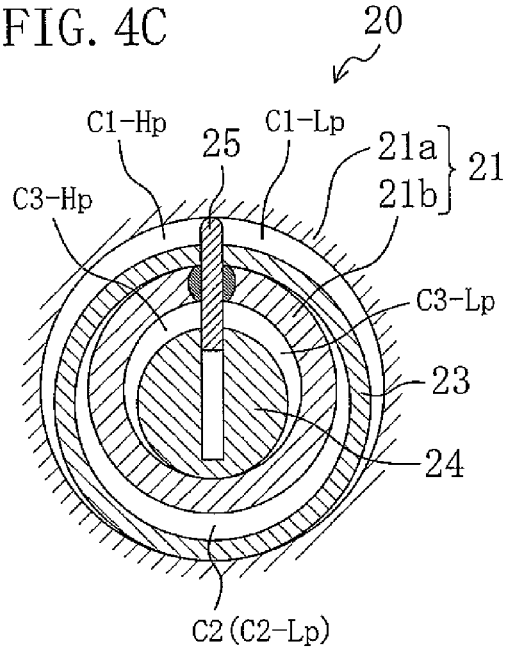
Figure 4B:
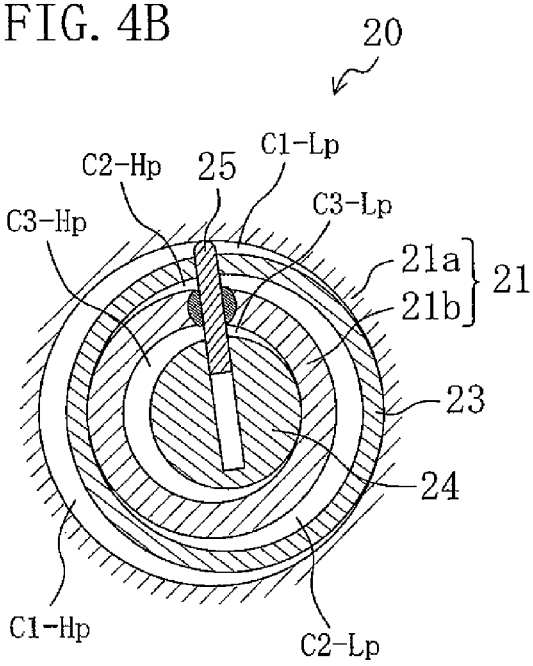
Figure 4D:
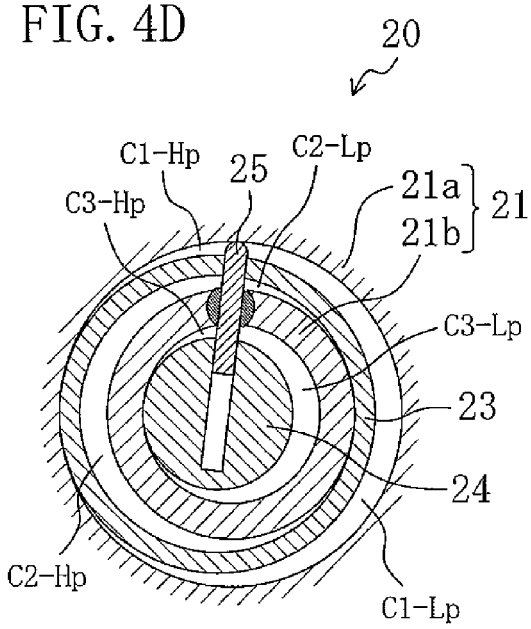

More specifically, in the external and internal side cylinder chambers (C1, C3), their low pressure chambers (C1-Lp, C3-Lp) are substantially minimized in volume in the state of FIG. 4(B), and as the drive shaft (33) rotates clockwise relative to the figure from this state to change its state to the state of FIG. 4(C), then to the state of FIG. 4(D), and then to the state of FIG. 4(A), the volume of each of the low pressure chambers (C1-Lp, C3-Lp) increases. With such increase, refrigerant is drawn into each of the low pressure chambers (C1-Lp, C3-Lp) by way of the suction pipe (14) and the suction port (41). At this point in time, refrigerant is drawn into the low pressure chamber (C3-Lp) of the internal side cylinder chamber (C3), not only from the suction port (41) but also from the low pressure chamber (C1-Lp) of the external side cylinder chamber (C1) by way of the through hole (43), the low pressure chamber (C2-Lp) of the intermediate cylinder chamber (C2), and the through hole (44).

When the drive shaft (33) rotates one revolution to reenter the state of FIG. 4(B), the suction of refrigerant into each of the low pressure chambers (C1-Lp, C3-Lp) is completed. Then, the low pressure chambers (C1-Lp, C3-Lp) become high pressure chambers (C1-Hp, C3-Hp) in each of which refrigerant is compressed, and new low pressure chambers (C1-Lp, C3-Lp) are defined on the other side of the blade (25). When the drive shaft (33) further rotates, the suction of refrigerant is repeatedly carried out in each of the low pressure chambers (C1-Lp, C3-Lp) while on the other hand the volume of each of the high pressure chambers (C1-Hp, C3-Hp) decreases whereby refrigerant is compressed in each of the high pressure chambers (C1-Hp, C3-Hp). When the pressure in each of the high pressure chambers (C1-Hp, C3-Hp) becomes a given value and the difference in pressure from the discharge space (47) reaches a preset value, the discharge valve (46) is placed in the open state by high pressure refrigerant in each of the high pressure chambers (C1-Hp, C3-Hp), and the high pressure refrigerant flows from the discharge space (47) into the high pressure space (S2) by way of the discharge passageway (47*a*).

In the intermediate cylinder chamber (C2), the low pressure chamber (C2-Lp) is substantially minimized in volume in the state of FIG. 4(D), and as the drive shaft (33) rotates clockwise relative to the figure from this state to change its state to the state of FIG. 4(A), then to the state of FIG. 4(B), and then to the state of FIG. 4(C), the volume of the low pressure chamber (C2-Lp) increases. With such increase, refrigerant is drawn into the low pressure chamber (C2-Lp) by way of the suction pipe (14) and the suction port (41). At this point in time, refrigerant is drawn into the low pressure chamber (C2-Lp), not only from the suction port (41) but also from the low pressure chamber (C1-Lp) of the external side cylinder chamber (C1) by way of the through hole (43).

When the drive shaft (33) rotates one revolution to reenter the state of FIG. 4(D), the suction of refrigerant into the low pressure chamber (C2-Lp) is completed. Then, the low pressure chamber (C2-Lp) now becomes a high pressure chamber (C2-Hp) in which refrigerant is compressed and a new low pressure chamber (C2-Lp) is defined on the other side of the blade (25). When the drive shaft (33) further rotates, the suction of refrigerant is repeatedly carried out in the low pressure chamber (C2-Lp) while on the other hand the volume of the high pressure chamber (C2-Hp) decreases whereby refrigerant is compressed in the high pressure chamber (C2-Hp). When the pressure in the high pressure chamber (C2-Hp) becomes a given value and the difference in pressure from the discharge space (47) reaches a preset value, the discharge valve (46) is placed in the open state by high pressure refrigerant in the high pressure chamber (C21-Hp), and the high pressure refrigerant flows from the discharge space (47) into the high pressure space (S2) by way of the discharge passageway (47*a*).

In the way as described above, the refrigerant after having being compressed to high pressure in each cylinder chamber (C1, C2, C3) and flowed out to the high pressure space (S2) is discharged from the discharge pipe (15). This discharged refrigerant undergoes, in the refrigerant circuit, a condensation process, an expansion process, and an evaporation process. Thereafter, the refrigerant is again drawn into the compressor (1).

Next, the operation of switching from the first state to the second state is described. In the first place, the blade back chamber (28) is set to the low pressure state; the movement working chamber (51) is set to the second state; and the back chamber (59) of the fixation working chamber (56) is set to the high pressure state. Consequently, the blade (25) moves backward in the blade groove (26) and the fixation piston (57) of the fixation working chamber (56) engages into the third fixation hole (55*c*) of the blade (25).

In the above-described state, when the electric motor (30) is activated, the ring-like piston (23) and the circular cylinder-like piston (24) orbit while swinging relative to the external side cylinder part (21*a*) and the internal side cylinder part (21*b*), and a given compression operation is carried out, as shown in FIG. 5. At that time, the tip of the blade (25) constantly lies at a slightly more interior position than the external peripheral surface of the ring-like piston (23) and, in addition, the blade (25) moves in a swing motion together with the swinging bush (29) with respect to the internal side cylinder part (21*b*).

More specifically, in any of the states of FIGS. 5(A) through 5(D), the external side cylinder chamber (C1) is not divided by the blade (25) into the low pressure chamber (C1-Lp) and the high pressure chamber (C1-Hp). Accordingly, the inflow refrigerant from the suction port (41) is flowed out from the discharge port (45) as it was flowed in. In other words, the external side cylinder chamber (C1) is placed in a so-called rest state in which the compression of refrigerant is not carried out.

Figure 5A:
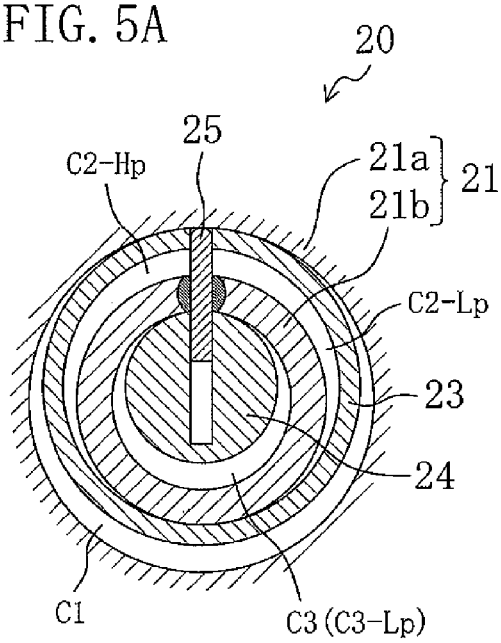
FIG. 5 is a transverse cross-sectional view illustrating how the compression mechanism of the first embodiment operates in a second state.
Figure 5C:
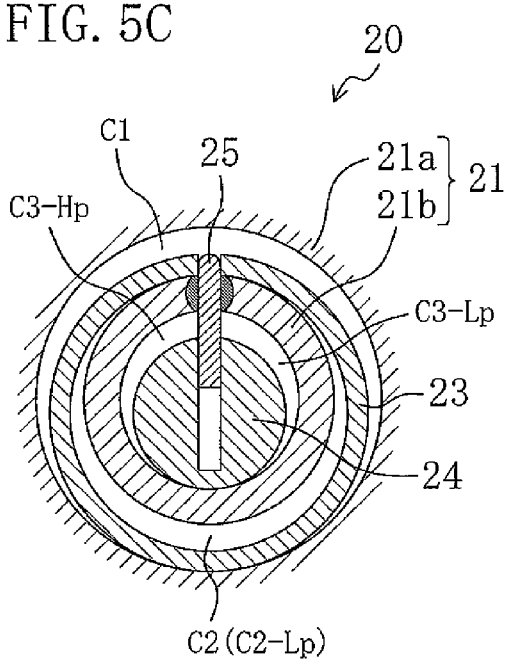
Figure 5B:
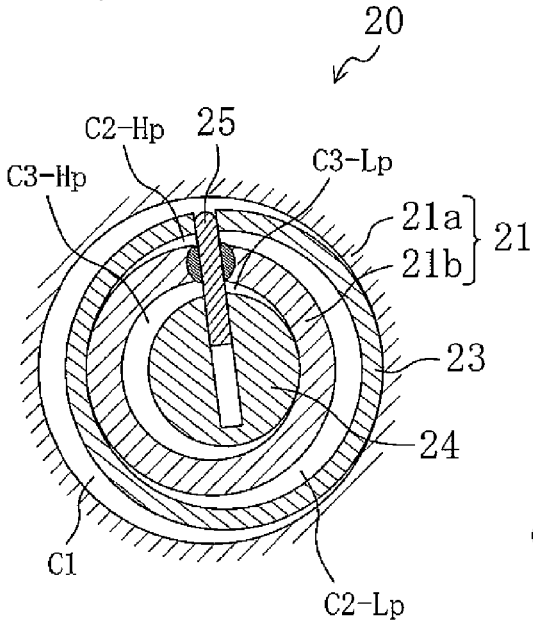
Figure 5D:
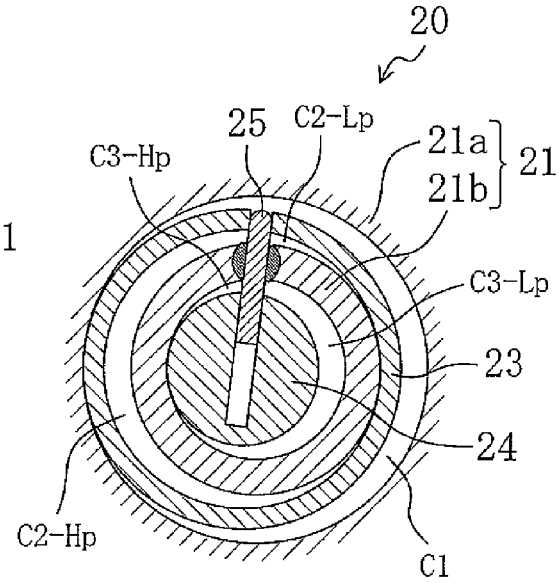

In the intermediate cylinder chamber (C2), the volume of the low pressure chamber (C2-Lp) is substantially minimized in the state of FIG. 5(D) and as in the first state, as the drive shaft (33) rotates clockwise relative to the figure to change its state to the state of FIG. 5(A), then to the state of FIG. 5(B), and then to the state of FIG. 5(C), refrigerant is drawn thereinto for compression.

In the internal side cylinder chamber (C3), the volume of the low pressure chamber (C3-Lp) is substantially minimized in the state of FIG. 5(B) and as in the first state, as the drive shaft (33) rotates clockwise relative to the figure to change its state to the state of FIG. 5(C), then to the state of FIG. 5(D), and then to the state of FIG. 5(A), refrigerant is drawn thereinto for compression. When compared to the first state, the capability of the compressor (1) in the second state falls to a lower level by an amount corresponding to the fact that the compression of refrigerant is not carried out in the external side cylinder chamber (C1).

Next, the operation of switching from the second state to the third state is described. In the first place, the back chamber (59) of the fixation working chamber (56) is set to the low pressure state. Consequently, the fixation piston (57) of the fixation working chamber (56) withdraws and comes out of the third fixation hole (55*c*) of the blade (25). Thereafter, the blade back chamber (28) is set to the low pressure state; the movement working chamber (51) is set to the second state; and the back chamber (59) of the fixation working chamber (56) is set to the high pressure state. Consequently, the blade (25) further moves backward in the blade groove (26), and the fixation piston (57) of the fixation working chamber (56) engages into the second fixation hole (55*b*) of the blade (25).

In the above-described state, when the electric motor (30) is activated, the ring-like piston (23) and the circular cylinder-like piston (24) orbit while swinging relative to the external side cylinder part (21*a*) and the internal side cylinder part (21*b*), and a given compression operation is carried out, as shown in FIG. 6. At that time, the tip of the blade (25) constantly lies at a position more exterior than the center of the swinging bush (29) and slightly more interior than the internal peripheral surface of the ring-like piston (23) and the blade (25) moves in a swing motion together with the swinging bush (29) with respect to the internal side cylinder part (21*b*).

More specifically, in the external side cylinder chamber (C1), the inflow refrigerant from the suction port (41) is not compressed, but is flowed out from the discharge port (45) as it was flowed in, as in the second state.

In any of the states of FIGS. 6(A) through 6(D), the intermediate cylinder chamber (C2) is not divided by the blade (25) into the low pressure chamber (C2-Lp) and the high pressure chamber (C2-Hp). Accordingly, the inflow refrigerant from the suction port (41) and the low pressure chamber (C1-Lp) of the external side cylinder chamber (C1) is flowed out from the discharge port (45) as it was flowed in. In other words, the intermediate cylinder chamber (C2) is placed in a so-called rest state in which the compression of refrigerant is not carried out.

Figure 6A:
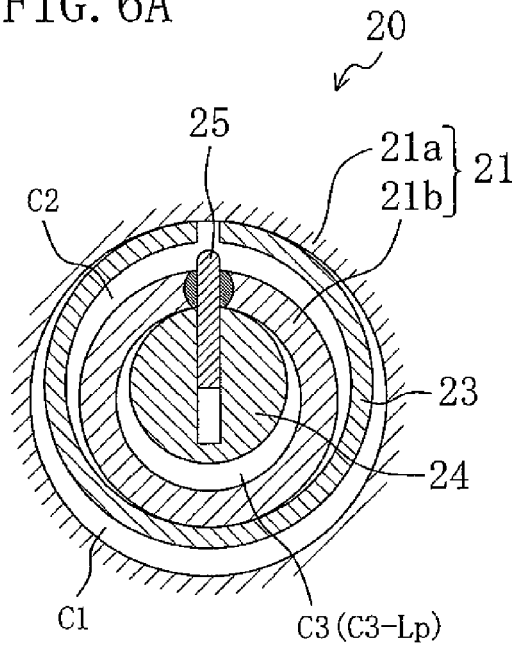
FIG. 6 is a transverse cross-sectional view illustrating bow the compression mechanism of the first embodiment operates in a third state.
Figure 6C:
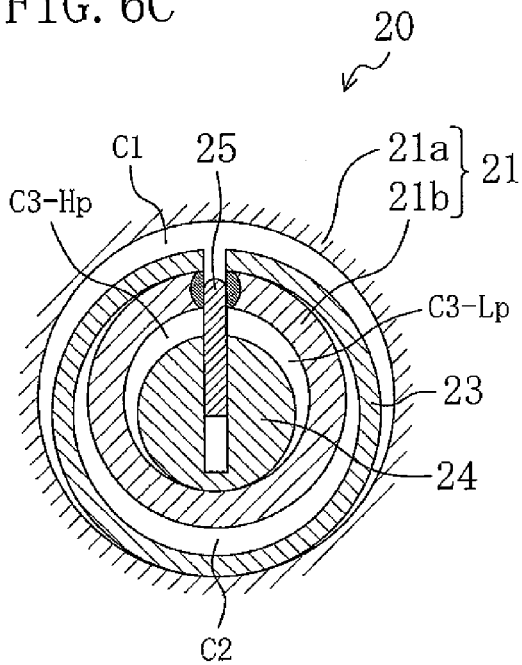
Figure 6B:
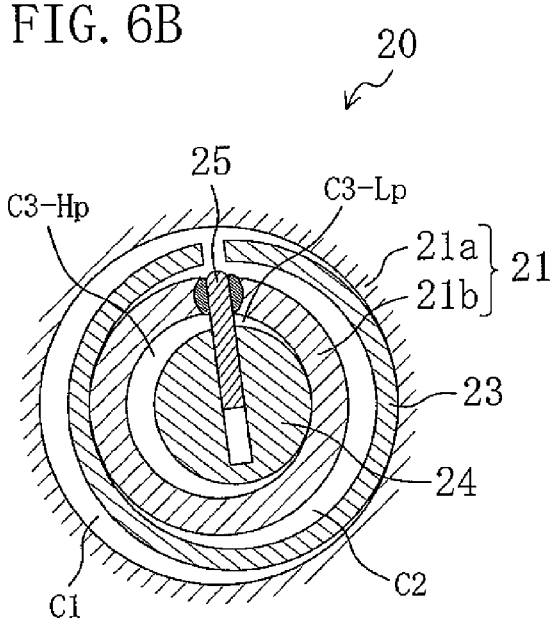
Figure 6D:
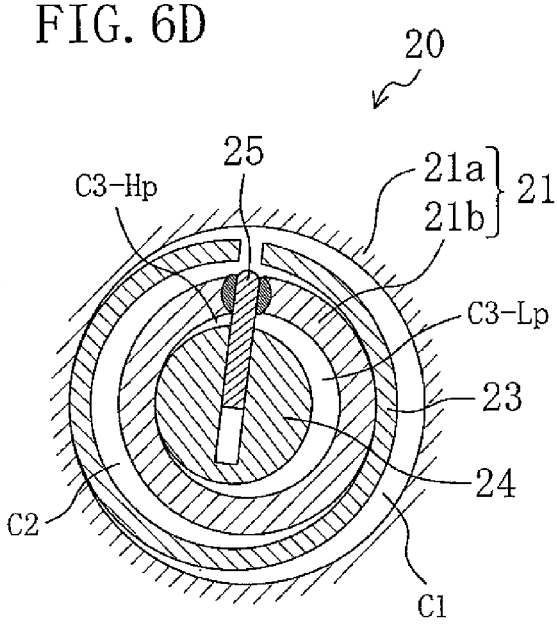
Figure 7A:
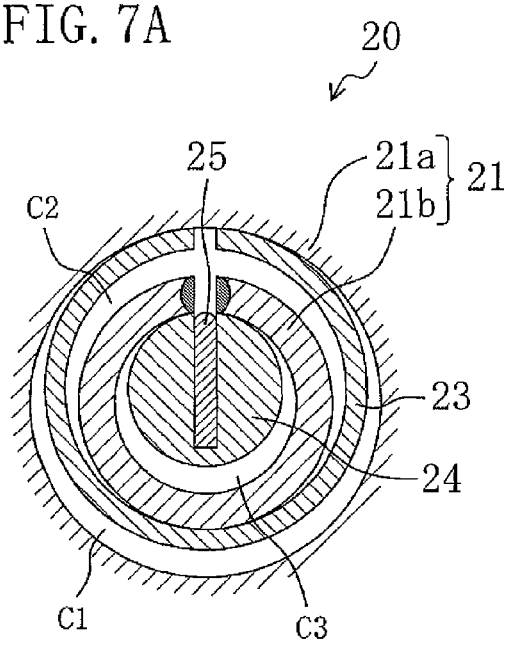
FIG. 7 is a transverse cross-sectional view illustrating how the compression mechanism of the first embodiment operates in a whole rest state.
Figure 7C:
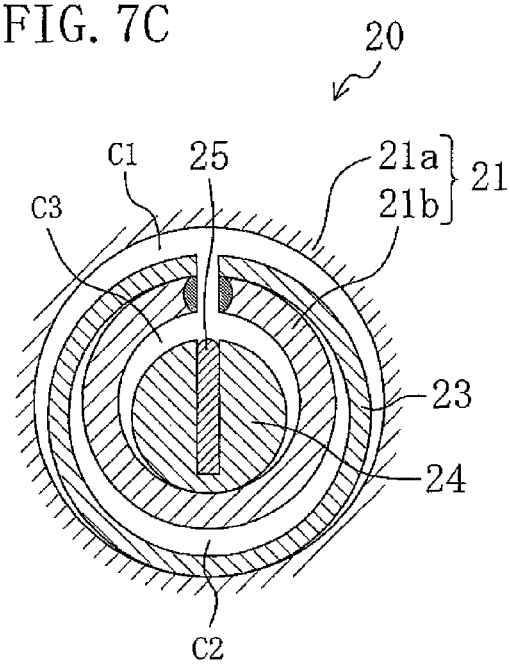
Figure 7B:
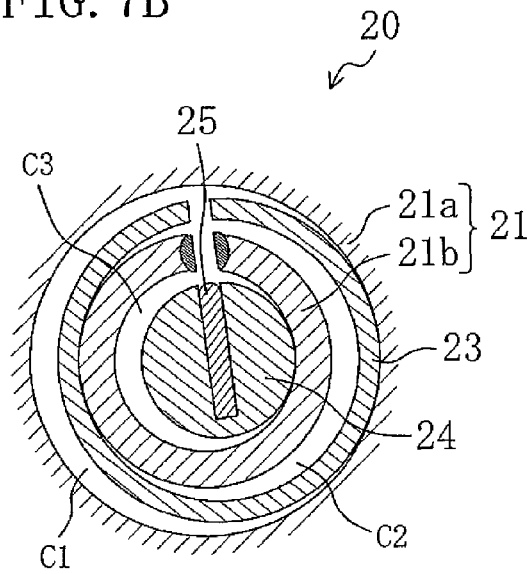
Figure 7D:
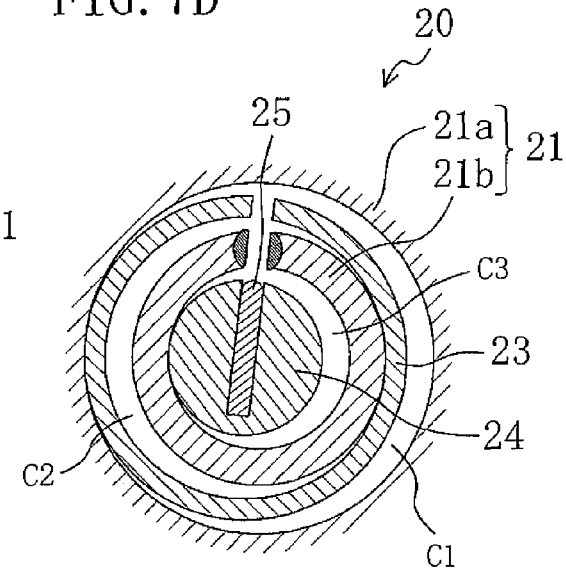

In the internal side cylinder chamber (C3), the volume of the low pressure chamber (C3-Lp) is substantially minimized in the state of FIG. 6(B) and as in the first state, as the drive shaft (33) rotates clockwise relative to the figure to change its state to the state of FIG. 6(C), then to the state of FIG. 6(D), and then to the state of FIG. 6(A), refrigerant is drawn thereinto for compression. When compared to the second state, the capability of the compressor (1) in the third state falls to a lower level by an amount corresponding to the fact that the compression of refrigerant is not carried out in the intermediate cylinder chamber (C2).

Next, the operation of switching from the third state to the whole rest state is described. In the first place, the back chamber (59) of the fixation working chamber (56) is set to the low pressure state. Consequently, the fixation piston (57) of the fixation working chamber (56) withdraws and comes out of the second fixation hole (55*b*) of the blade (25). Thereafter, the blade back chamber (28) is set to the low pressure state; the movement working chamber (51) is set to the second state; and the back chamber (59) of the fixation working chamber (56) is set to the high pressure state. Consequently, the blade (25) further moves backward in the blade groove (26), and the fixation piston (57) of the fixation working chamber (56) engages into the first fixation hole (55*a*) of the blade (25).

In the above-described state, when the electric motor (30) is activated, the ring-like piston (23) and the circular cylinder-like piston (24) orbit while swinging relative to the external side cylinder part (21*a*) and the internal side cylinder part (21*b*), and a given compression operation is carried out, as shown in FIG. 7. At that time, the entire blade (25) is accommodated in the blade groove (26) and made stationary therein. In other words, it is arranged such that the tip of the blade (25) does not go out of the external peripheral surface of the circular cylinder-like piston (24).

More specifically, in the external side cylinder chamber (C1) and the intermediate cylinder chamber (C2), the inflow refrigerant is not compressed, but is flowed out from the discharge port (45) as it was flowed in, as in the third state.

In any of the states of FIGS. 7(A) through 7(D), the internal side cylinder chamber (C3) is not divided by the blade (25) into the low pressure chamber (C3-Lp) and the high pressure chamber (C3-Hp). Accordingly, the inflow refrigerant from the suction port (41) and so on is flowed out from the discharge port (45) as it was flowed in. In other words, the internal side cylinder chamber (C3) is placed in a so-called rest state in which the compression of refrigerant is not carried out. As just described, since the compression of refrigerant is not carried out in any of the three cylinder chambers (C1, C2, C3) in the whole rest state, the capability of the compressor (1) becomes zero.

On the other hand, for example, at the time of the operation of sequential switching from the whole rest state to the third state, then to the second state, then to the first state, in other words when increasing the volume of the compressor (1), the movement working chamber (51) is set to the first state to cause the blade (25) to move radially outwardly whereby the fixation piston (57) engages into a predetermined one of the fixation holes (55*a*, 55*b*, 55*c*).

Also note that in the present first embodiment, it is possible to perform not only sequential switching among the states but also direct switching to the third state or to the whole rest state from the first state to thereby considerably reduce the capability of the compressor (1) or to the first state from the whole rest state to thereby considerably increase the capability of the compressor (1).

Advantageous Effects of the First Embodiment

As described above, in accordance with the present first embodiment, the three cylinder chambers (C1, C2, C3) are defined in the radial direction of the cylinder (21) and the blade (25) inserted into the circular cylinder-like piston (24) is inserted through the internal side cylinder part (21*b*) and then through the ring-like piston (23) while being in sliding contact therewith to be moved backward/forward, whereby the cylinder chambers (C1, C2, C3) which are divided into the low pressure chambers (C1-Lp, . . . ) and the high pressure chambers (C1-Hp, . . . ) can be made variable in numeric quantity by forcing the blade (25) to move backward/forward to a given one of the positions. This therefore makes it possible to control the capability of the compressor (1).

In addition, what is required is just to cause the single blade (25) to move backward/forward, thereby making it easy to change the capability of the compressor (1), and unlike the conventional technology the blade (25) is prevented from undergoing one-side hitting in the ring-like piston (23), thereby making it possible to prevent the ring-like piston (23) and the internal side cylinder part (21*b*) from being damaged. As a result, the reliability of the equipment is improved. In addition, the swinging bush (29) is mounted in the cutaway portion of the internal side cylinder part (21*b*) so that the blade (25) is held in a swingable manner, thereby making it possible to ensure that the ring-like piston (23) and the circular cylinder-like piston (24) orbits while swinging together with the blade (25).

Besides, the compressor (1) of the present embodiment can be placed in the whole rest state. This therefore makes it possible to reduce the capability of the compressor (1) to zero without bothering stopping the electric motor (30), for example, when the operation is frequently repeatedly started and stopped. Consequently, although the starting current higher than the current flowing during operation flows when the electric motor (30) is activated, the cost of electricity due to the starting current can be saved.

Additionally, the blade groove (26) is formed in the substantially centrally located circular cylinder-like piston (24), whereby the diameter of the entire cylinder (21) can be reduced in comparison with a conventional rotary type compressor in which the blade groove is formed in the cylinder and the blade is moved backward/forward therein. As a result of this, the size of the compressor (1) can be made compact.

Variation of the First Embodiment

Figure 14:
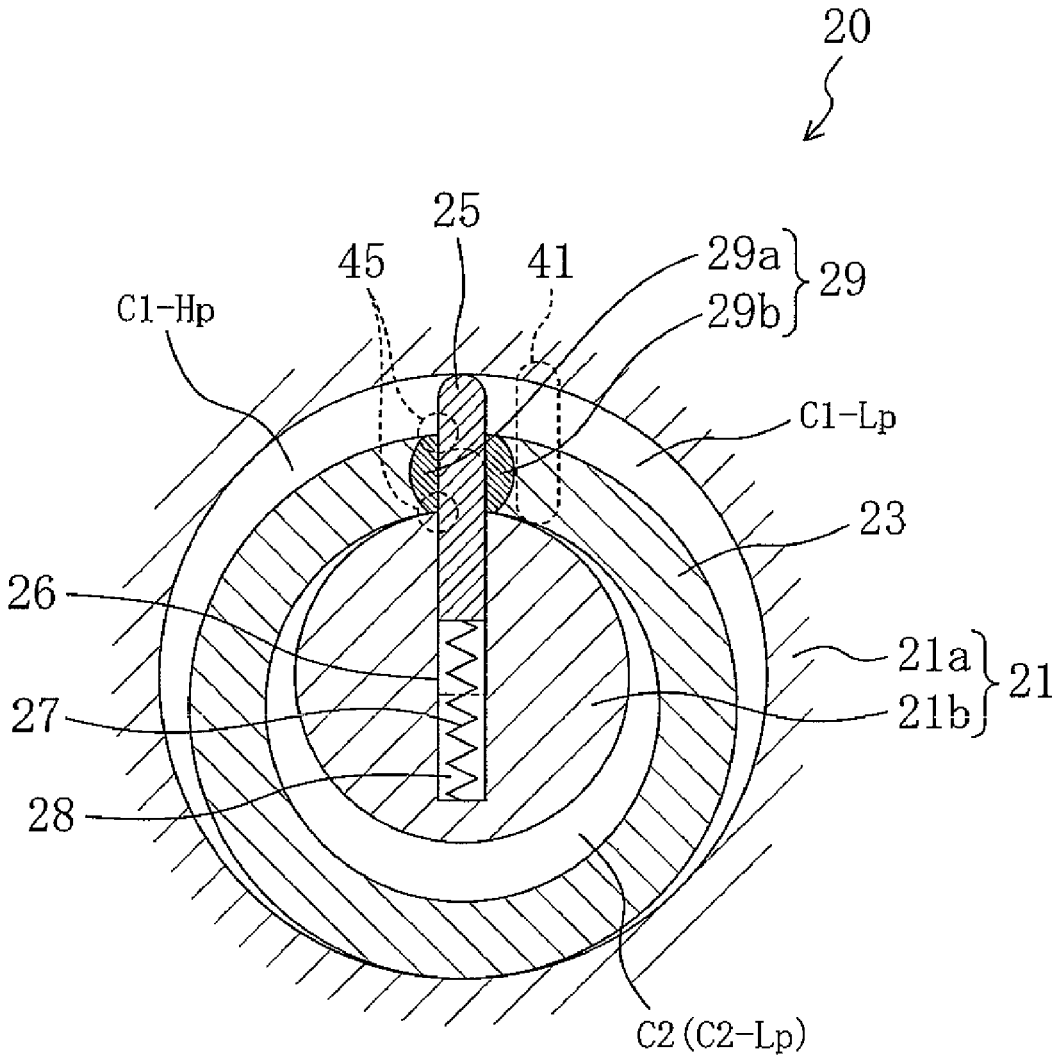
FIG. 14 is a transverse cross-sectional view illustrating a compression mechanism according to an example of the modification of the first embodiment.

Referring to FIG. 14, there is shown a variation of the first embodiment. In the arrangement of the first embodiment, three cylinder chambers, i.e., the cylinder chambers (C1, C2, C3), are defined. However, in the present variation, instead of defining three cylinder chambers, two cylinder chambers, i.e., the cylinder chambers (C1, C2), are defined. In other words, in the present variation, the circular cylinder-like piston (24) provided in the first embodiment is omitted and the internal side cylinder part (21*b*) is formed into a solid circular cylinder shape configuration.

More specifically, in the compression mechanism (20), the cylinder chamber (C1, C2) is divided by the ring-like piston (23) into the external side cylinder chamber (C1) and the internal side cylinder chamber (C2). The blade groove (26) is formed in the internal side cylinder part (21*b*) such that it extends in the radial direction of the internal side cylinder part (21*b*). The blade (25) is advanceably/retractably inserted into the blade groove (26). The swinging bush (29) is mounted in the cutaway portion of the ring-like piston (23). And the blade (25) is configured to move backward/forward to enter either (i) a first state (indicated by solid line in FIG. 14) in which the tip of the blade (25) is inserted through the swinging bush (29) to come into contact with the internal peripheral surface of the external side cylinder part (21*a*), (ii) a second state (indicated by chain double-dashed line in FIG. 14) in which the tip is positioned in the swinging bush (29) thereby placing the external side cylinder chamber (C1) in the form of an undivided single space, or (iii) a third state (not diagrammatically shown) in which the tip is positioned in the blade groove (26) thereby placing both the external side cylinder chamber (C1) and the internal side cylinder chamber (C2) in the form of respective undivided single spaces.

In the way as described above, since the volume of compression becomes lower in the order of the first state, the second state, and the third state, it becomes possible to control the volume of compression just by causing the single blade (25) to move backward/forward. Other configurations, operations, and working-effects are the same as described in the first embodiment.

Second Embodiments of the Invention

In the first embodiment, the blade groove (26) is formed in the circular cylinder-like piston (24). However, in the compressor (1) of the second embodiment, the blade groove (26)

is formed in the external side cylinder part (21*a*). In addition, in the second embodiment, the movable mechanism of the blade (25) of the first embodiment is modified.

Figure 8:
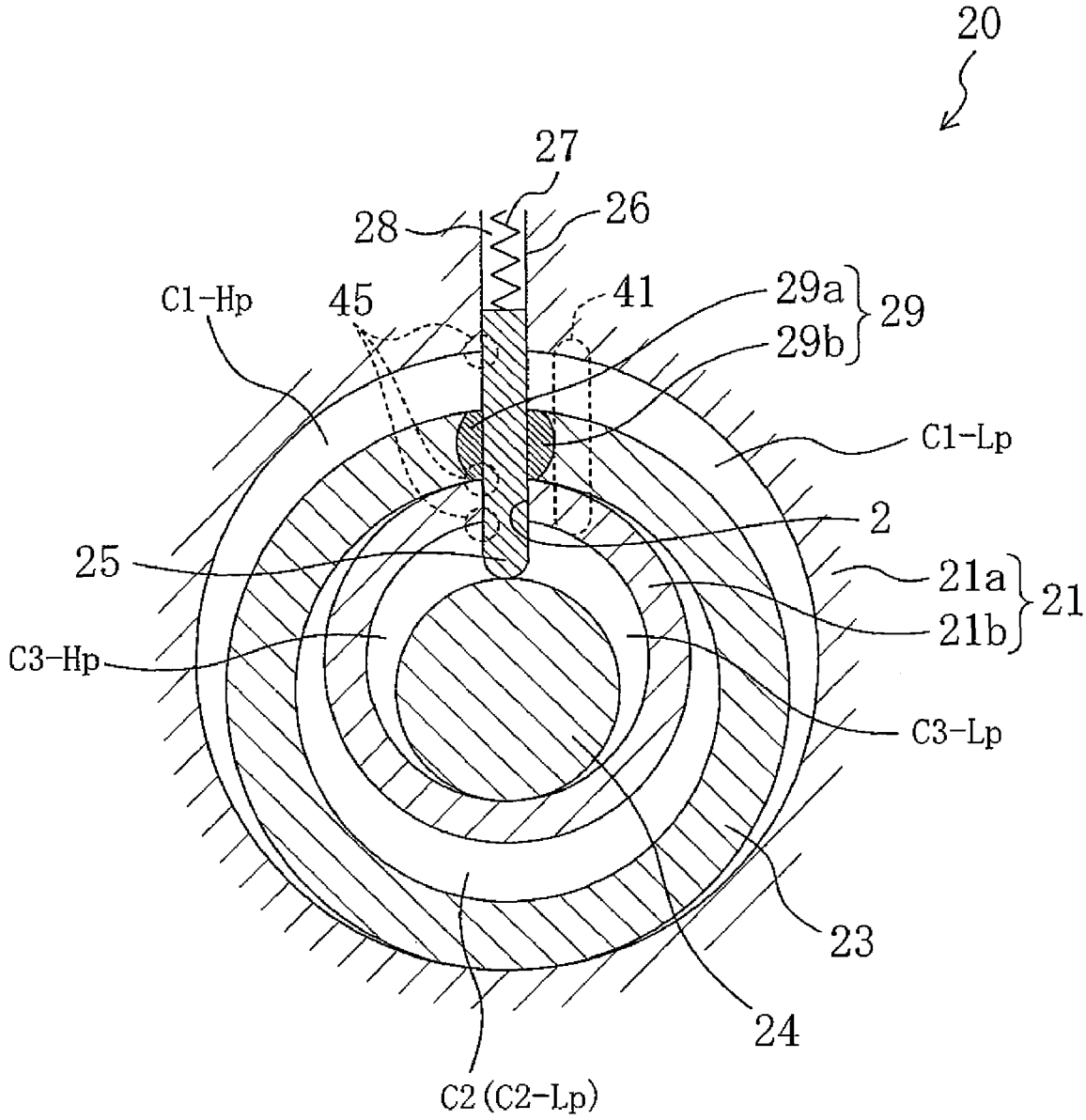
FIG. 8 is a transverse cross-sectional view illustrating a compression mechanism according to a second embodiment of the present invention.

As shown in FIG. 8, the blade groove (26) is formed along the radial direction of the external side cylinder part (21*a*). The blade (25) is inserted advanceably/retractably and slidably along the radial direction of the external side cylinder part (21*a*) into the blade groove (26). Mounted within the blade back chamber (28) of the blade groove (26) is a spring (27) by which the blade (25) is biased inwardly in the radial direction. And, as in the first embodiment, the blade (25) is configured such that it can divide the cylinder chamber (C1, C2, C3) into the high pressure chamber (C1-Hp, C2-Hp, C3-Hp) and the low pressure chamber (C1-Lp, C2-Lp, C3-Lp).

In the present embodiment, the swinging bush (29) through which the blade (25) is inserted is mounted not in the internal side cylinder part (21*b*), but in the ring-like piston (23). The ring-like piston (23) is formed in a C-shaped configuration, i.e., a ring shape with a cutaway portion. And the swinging bush (29) is mounted in the cutaway portion of the ring-like piston (23). The swinging bush (29) is configured such that it swings together with the ring-like piston (23) with respect to the blade (25).

The internal side cylinder part (21*b*) is formed in a C-shaped configuration, i.e., a ring shape with a cutaway portion. The cutaway portion of the internal side cylinder part (21*b*) constitutes a blade insertion part (2) for insertion of the blade (25) therethrough. In other words, the blade (25) slides in the blade insertion part (23*a*).

In addition, the compression mechanism (20) is configured such that the cylinder chambers (C1, C2, C3) which are divided into the high pressure chambers (C1-Hp, . . . ) and the low pressure chambers (C1-Lp, . . . ) by the blade (25) are made variable in numeric quantity. In other words, the blade (25) is movable such that it changes state between four different states, namely, a first state in which all of the three cylinder chambers (C1, C2, C3) are subjected to division, a second state in which only the external side cylinder chamber (C1) and the intermediate cylinder chamber (C2) are subjected to division, a third state in which only the external side cylinder chamber (C1) is subjected to division, and a whole rest state in which none of the three cylinder chambers (C1, C2, C3) are subjected to division.

Figure 9:
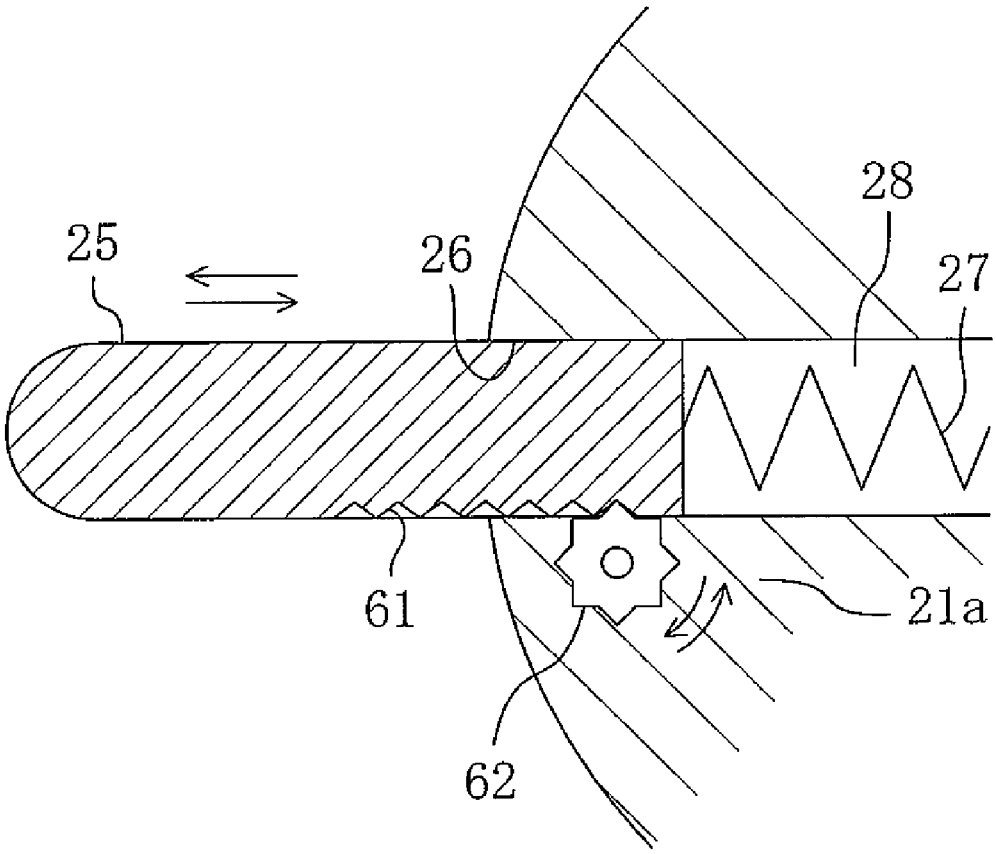
FIG. 9 is a transverse cross-sectional view illustrating an essential part of the compression mechanism of the second embodiment.
Figure 10A:
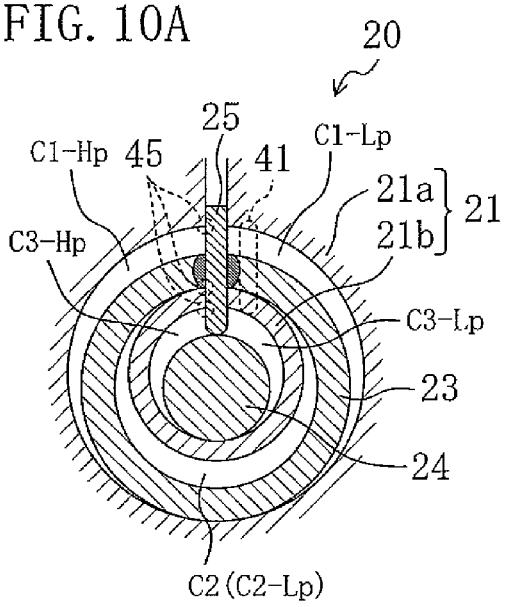
FIG. 10 is a transverse cross-sectional view illustrating the compression mechanism of the second embodiment operates in a first state.
Figure 10C:
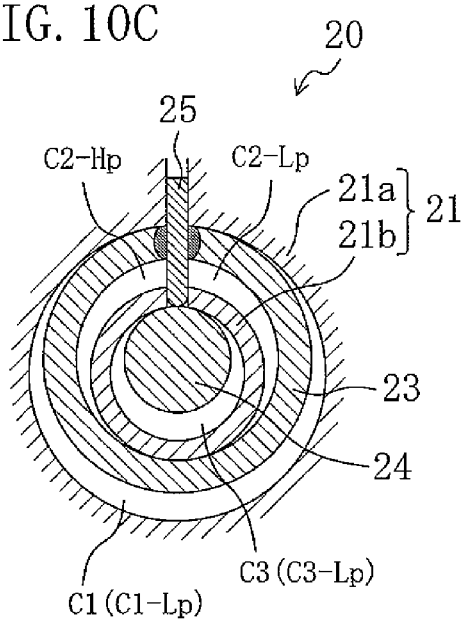
Figure 10B:
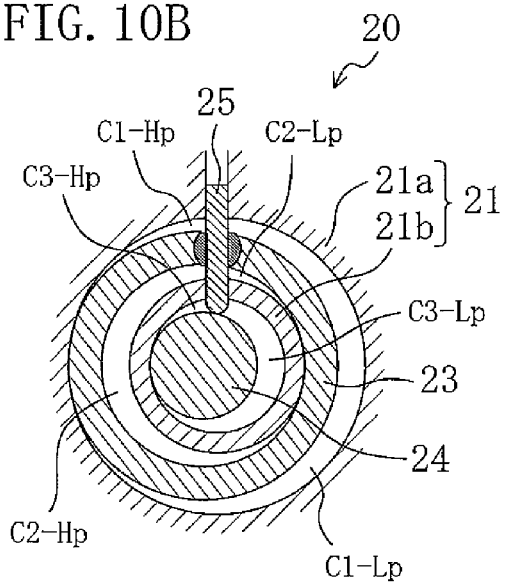
Figure 10D:
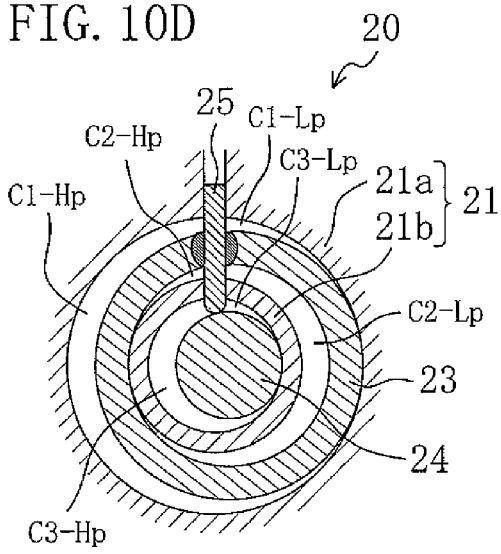
Figure 11A:
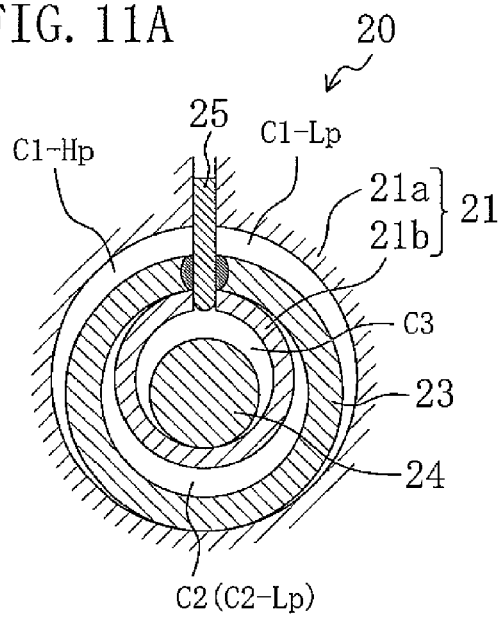
FIG. 11 is a transverse cross-sectional view illustrating how the compression mechanism of the second embodiment operates in a second state.
Figure 11C:
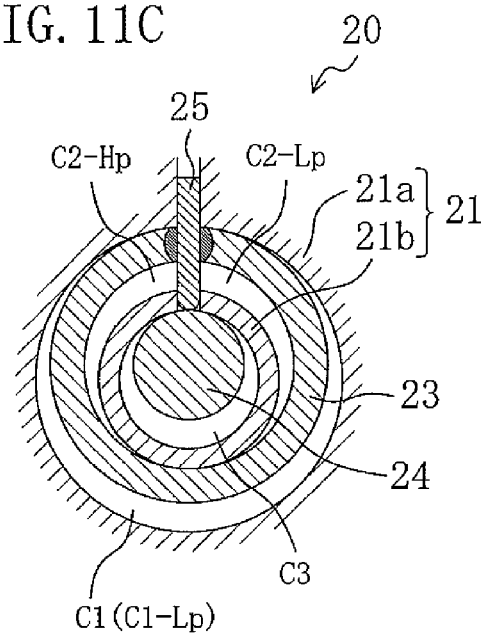
Figure 11B:
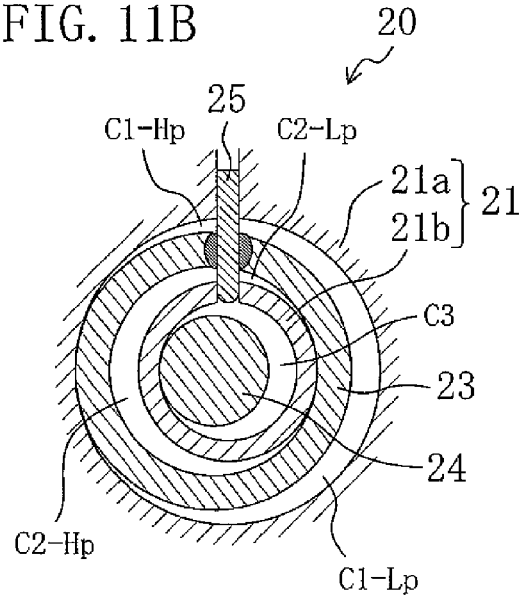
Figure 11D:
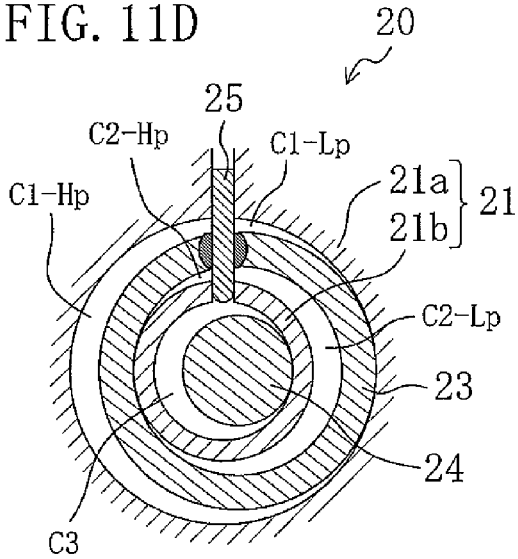
Figure 12A:
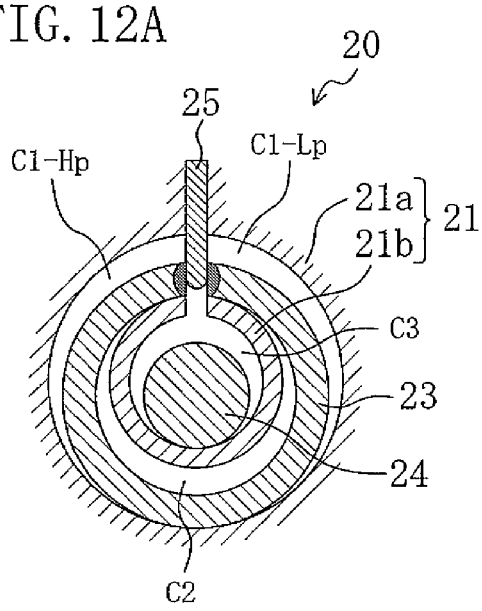
FIG. 12 is a transverse cross-sectional view illustrating how the compression mechanism of the second embodiment operates in a third state.
Figure 12C:
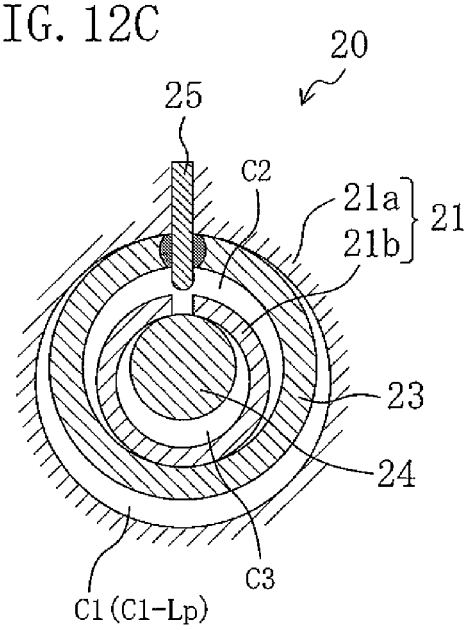
Figure 12B:
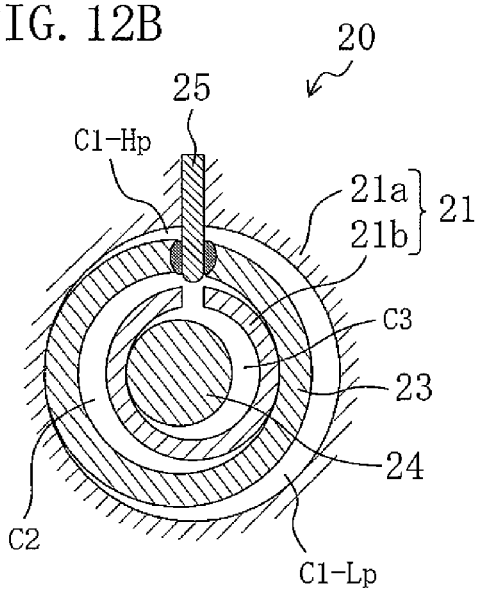
Figure 12D:
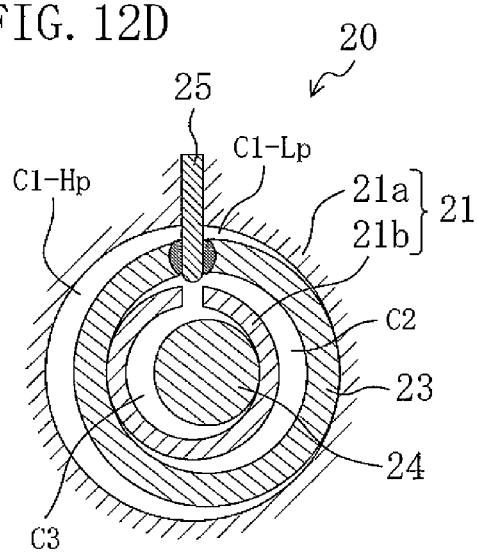
Figure 13A:
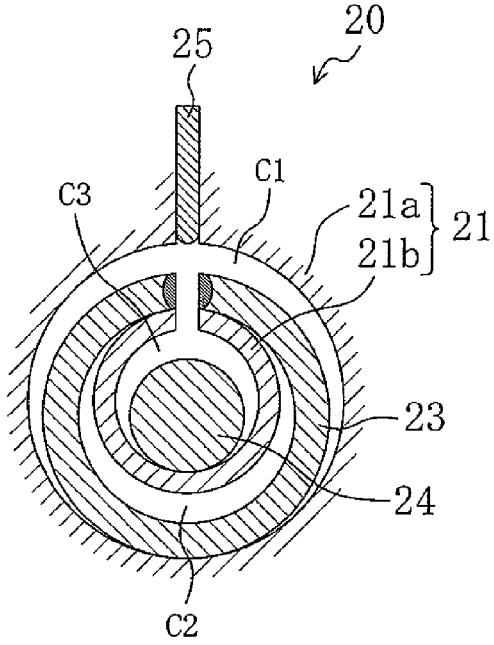
FIG. 13 is a transverse cross-sectional view illustrating how the compression mechanism of the second embodiment operates in a whole rest state.
Figure 13C:
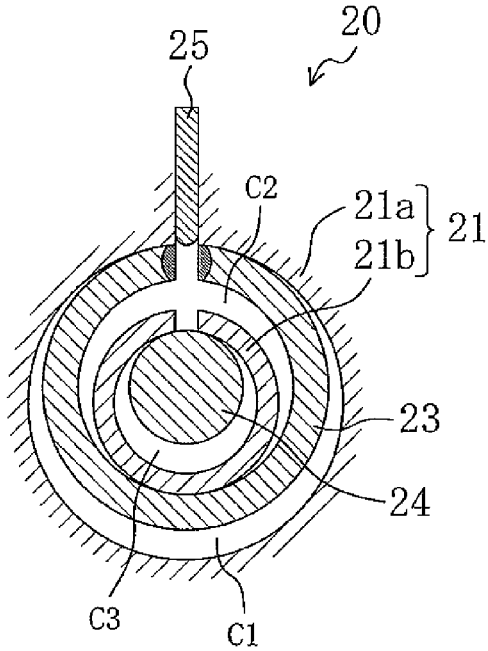
Figure 13B:
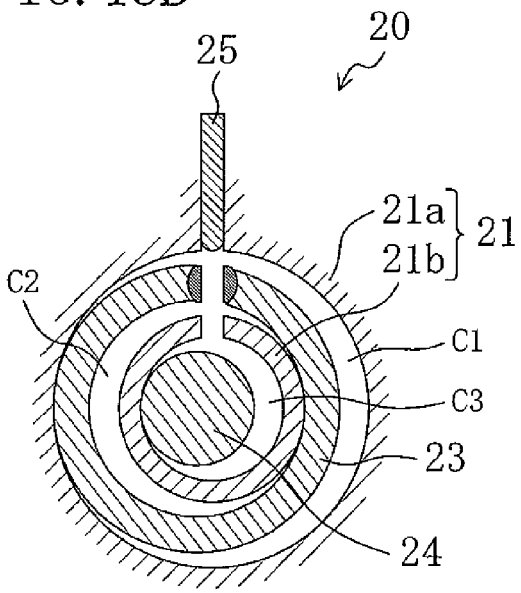
Figure 13D:
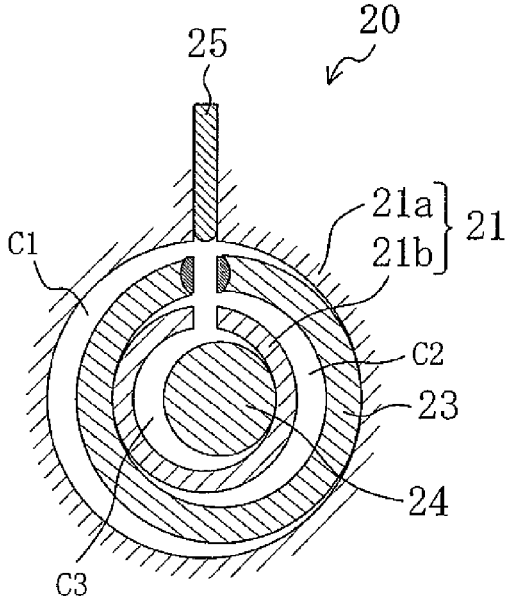

As shown in FIG. 9, a rack (61) is formed in one side surface of the blade (25). The rack (61) is formed along the width direction (horizontal direction in FIG. 9) of the blade (25). Mounted in the inside of the external side cylinder part (21*a*) is a pinion gear (62). The pinion gear (62) engages with the rack (61) formed in the blade (25) and is configured such that it rotates to cause the blade (25) to move backward/forward relative to the blade groove (26). Also note that although not diagrammatically shown, the pinion gear (62) is coupled, for example, to the drive shaft of a separately provided step motor (not shown) so that it is driven to reversibly rotate.

More specifically, for the first state, the coupling between the pinion gear (62) and the drive shaft of the step motor is discontinued, thereby placing the pinion gear (62) in such a state that it rotates substantially free from resistance. In other words, the blade (25) is biased outwardly in the radial direction of the external side cylinder part (21*a*) by the spring (27) to move backward/forward so that the tip of the blade (25) is constantly in contact with the external peripheral surface of the circular cylinder-like piston (24). Accordingly, as shown in FIG. 10, each cylinder chamber (C1, C2, C3) is divided into the low pressure chamber (C1-Lp, C2-Lp, C3-Lp) and the high pressure chamber (C1-Hp, C2-Hp, C3-Hp), and the compression of refrigerant is carried out in each of the cylinder chambers (C1, C2, C3). Also note that the operation of refrigerant suction and the operation of refrigerant compression in each cylinder chamber (C1, C2, C3) are the same as described in the first state of the first embodiment.

Next, at the time of switching from the first state to the second state, the step motor is activated to cause the pinion gear (62) to rotate clockwise relative to FIG. 9 ("forward rotation" in the present embodiment), whereby the blade (25) is forced to move backward in the blade groove (26). And, as shown in FIG. 11, with the tip of the blade (25) positioned in the blade insertion part (23*a*) of the internal side cylinder part (21*b*), the pinion gear (62) is stopped rotating to make the blade (25) stationary relative to the blade groove (26). Consequently, only the external side cylinder chamber (C1) and the intermediate cylinder chamber (C2) are subjected to division. That is, the external side cylinder chamber (C1) is divided into the low pressure chamber (C1-Lp) and the high pressure chamber (C1-Hp) and the intermediate cylinder chamber (C2) is divided into the low pressure chamber (C2-Lp) and the high pressure chamber (C2-Hp), and the compression of refrigerant is carried out. On the other hand, the internal side cylinder chamber (C3) is placed at rest. As described above, when compared to the first state, the capability of the compressor (1) in the second state falls to a lower level by an amount corresponding to the fact that the compression of refrigerant is not carried out in the internal side cylinder chamber (C3).

Next, at the time of switching from the second state to the third state, the pinion gear (62) is further rotated clockwise to force the blade (25) to move backward in the blade groove (26). And, as shown in FIG. 12, with the tip of the blade (25) positioned more exterior than the external peripheral surface of the internal side cylinder part (21*b*) and more interior than the center of the swinging bush (29), the pinion gear (62) is stopped rotating to make the blade (25) stationary relative to the blade groove (26). Consequently, only the external side cylinder chamber (C1) is divided into the low pressure chamber (C1-Lp) and the high pressure chamber (C1-Hp) and the compression of refrigerant is carried out. On the other hand, the internal side cylinder chamber (C3) and the intermediate cylinder chamber (CZ) are placed at rest. As described above, when compared to the second state, the capability of the compressor (1) in the third state falls to a lower level by an amount corresponding to the fact that the compression of refrigerant is not carried out in the intermediate cylinder chamber (C2).

Next, at the time of switching from the third state to the whole rest state, the pinion gear (62) is further rotated clockwise to force the blade (25) to move backward in the blade groove (26). And, as shown in FIG. 13, with the entire blade (25) accommodated in the blade groove (26), the pinion gear (62) is stopped rotating to make the blade (25) stationary relative to the blade groove (26). Consequently, any one of the three cylinder chambers (C1, C2, C3) is not divided into the low pressure chamber (C1-Lp, C2-Lp, C3-Lp) and the high pressure chamber (C1-Hp, C2-Hp, C3-Hp), and the compression of refrigerant is not carried out thereby reducing the capability of the compressor (1) to zero.

On the other hand, for example, at the time of the operation of sequential switching from the whole rest state to the third state, then to the second state, then to the first state, in other words when increasing the volume of the compressor (1), the pinion gear (62) is made to rotate counterclockwise relative to FIG. 9 ("reverse rotation" in the present embodiment), whereby the blade (25) is moved radially inwardly to be made stationary at a predetermined position. Other configurations, operations, and working-effects are the same as described in the first embodiment.

In addition, in the present embodiment, the blade (25) is driven by the rack (61) and the pinion gear (62). Alternatively, the method of moving the blade (25) employed in the first embodiment may be used. Stated another way, it may be arranged such that a movement working chamber is formed in the blade (25) while a fixation working chamber is formed in the external side cylinder part (21*a*).

Variation of the Second Embodiment

Figure 15:
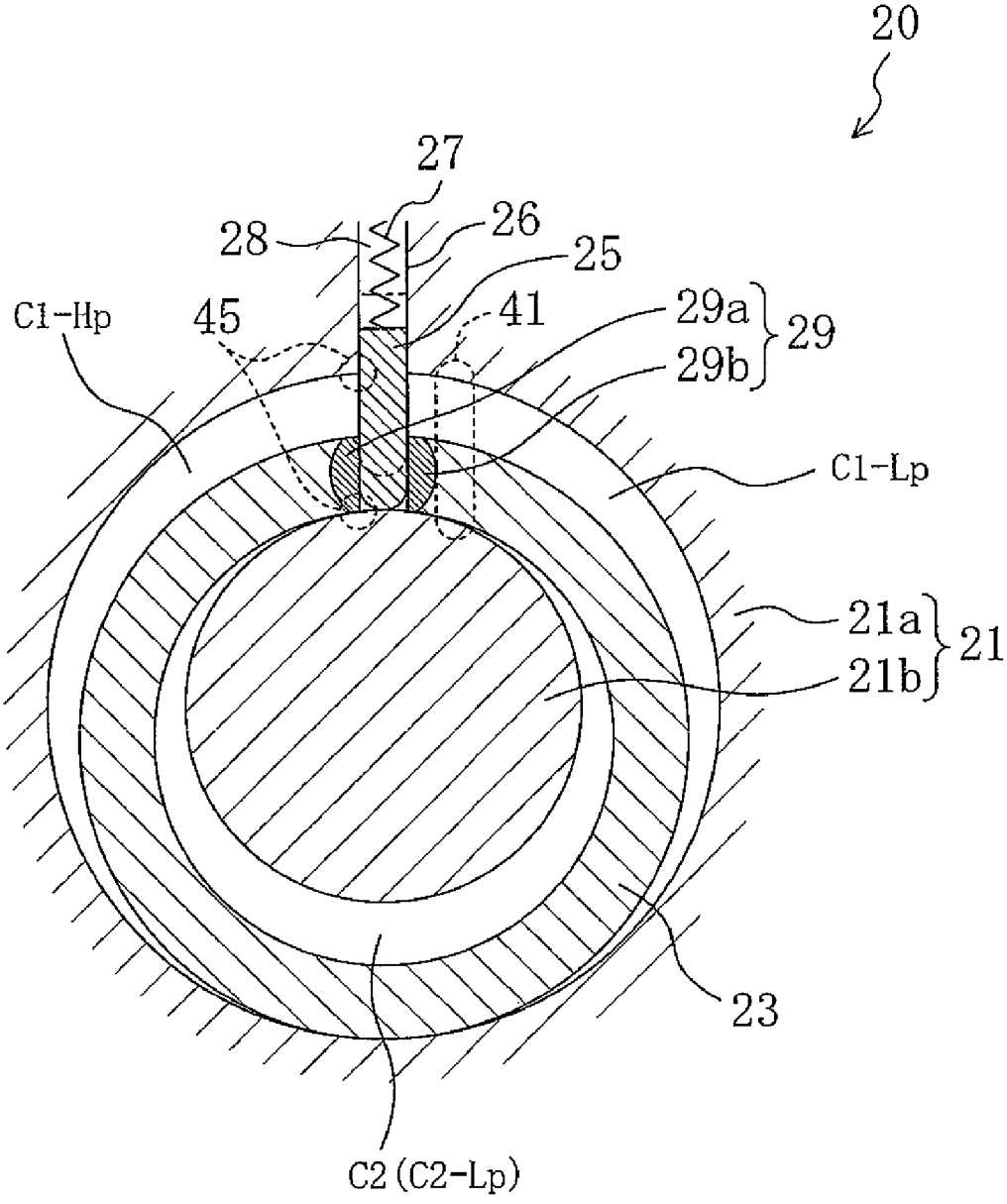
FIG. 15 is a transverse cross-sectional view illustrating a compression mechanism according to an example of the modification of the second embodiment.

Referring to FIG. 15, there is shown a variation of the second embodiment. In the arrangement of the first embodiment, three cylinder chambers, i.e., the cylinder chambers (C1, C2, C3), are defined. However, in the present variation, instead of defining three cylinder chambers, two cylinder chambers, i.e., the cylinder chambers (C1, C2), are defined. In other words, in the present variation, the circular cylinder-like piston (24) provided in the second embodiment is omitted and the internal side cylinder part (21*b*) is formed into a solid circular cylinder shape configuration.

More specifically, in the compression mechanism (20), the cylinder chamber (C1, C2) is divided by the ring-like piston (23) into the external side cylinder chamber (C1) and the internal side cylinder chamber (C2). The blade groove (26) is formed in the external side cylinder part (21*a*) such that it extends in the radial direction of the external side cylinder part (21*a*). The blade (25) is advanceably/retractably inserted into the blade groove (26). The swinging bush (29) is mounted in the cutaway portion of the ring-like piston (23). And the blade (25) is configured to move backward/forward to enter either (i) a first state (indicated by solid line in FIG. 15) in which the tip of the blade (25) is inserted through the swinging bush (29) to come into contact with the external peripheral surface of the internal side cylinder part (21*b*), (ii) a second state (indicated by chain double-dashed line in FIG. 15) in which the tip is positioned in the swinging bush (29) thereby placing the internal side cylinder chamber (C2) in the form of an undivided single space, or (iii) a third state (not diagrammatically shown) in which the tip is positioned in the blade groove (26) thereby placing both the external side cylinder chamber (C1) and the internal side cylinder chamber (C2) in the form of respective undivided single spaces.

In the way as described above, since the volume of compression becomes lower in the order of the first state, the second state, and the third state, it becomes possible to control the volume of compression just by causing the single blade (25) to move backward/forward. Other configurations, operations, and working-effects are the same as described in the second embodiment.

Third Embodiments of the Invention

Figure 16:
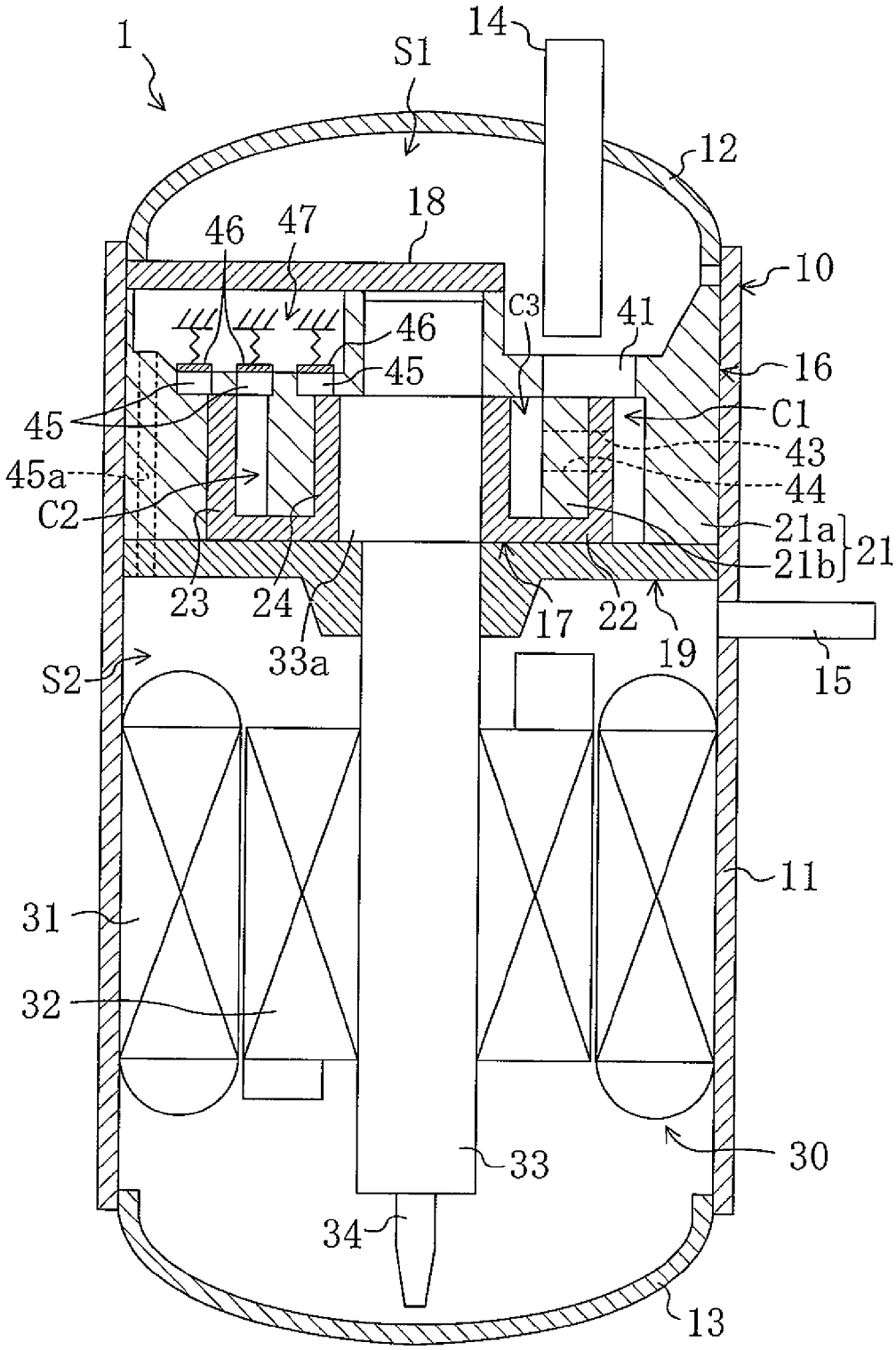
FIG. 16 is a longitudinal cross-sectional view illustrating a compressor according to a third embodiment of the present invention.

In the arrangement of the first embodiment, the single blade (25) is used to divide the three cylinder chambers (C1, C2, C3) into the high pressure chambers (C1-Hp, . . . ) and the low pressure chambers (C1-Lp, . . . ). However, in the compressor (1) of the third embodiment, instead of using the blade (25), two blade members (25*a*, 25*b*) are used to divide the cylinder chambers (C1, C2, C3) into the high pressure chambers (C1-Hp, . . . ) and the low pressure chambers (C1-Lp, . . . ), as shown in FIGS. 16 and 17.

In addition, in the arrangement of the first embodiment in which the ring-like piston (23) and the circular cylinder-like piston (24) are provided to serve respectively as an external piston part and as an internal piston part. However, in the present embodiment, a first ring-like piston (23) and a second ring-like piston (24) are provided to serve respectively as an external piston part and as an internal piston part. Also note that the drive shaft (33) runs through the eccentric rotation part (17) in the up and down direction, and the eccentric part (33*a*) engages with the inner part of the second ring-like piston (24).

The compression mechanism (20) has, in addition to the upper housing (16), a lower housing (19), and the eccentric rotation part (17) is positioned between these housings. The lower housing (19) is firmly secured to the casing (10) to rotatably support the drive shaft (33).

As shown in FIG. 17, the compression mechanism (20) has, as a blade, the internal side blade member (25*a*) and the external side blade member (25*b*).

The internal side blade member (25*a*) is formed integrally with the first ring-like piston (23) and the second ring-like piston (24). The internal side blade member (25*a*) is formed such that it extends from the internal peripheral surface of the first ring-like piston (23) to the external peripheral surface of the second ring-like piston (24) in the radial direction of the pistons (23, 24), and is inserted through the swinging bush (29) mounted in the cutaway portion of the internal side cylinder part (21*b*). Accordingly, the intermediate cylinder chamber (C2) is always divided by the internal side blade member (25*a*) into the high pressure chamber (C2-Hp) and the low pressure chamber (C2-Lp) and the internal side cylinder chamber (C3) is always divided by the internal side blade member (25*a*) into the high pressure chamber (C3-Hp) and the low pressure chamber (C3-Lp).

The pistons (23, 24) move in a swing motion together with the swinging bush (29) with respect to the cylinder (21) and move in a backward/forward motion together with the internal side blade member (25*a*) with respect to the cylinder (21).

The external side blade member (25*b*) is inserted advanceably/retractably along the radial direction of the external side cylinder part (21*a*) into the blade groove (26) formed in the external side cylinder part (21*a*). The blade back chamber (28) of the blade groove (26) is provided with a spring (27) by which the external side blade member (25*b*) is biased inwardly in the radial direction of the external side cylinder part (21*a*). And the blade back chamber (28) is configured such that it is switchable between one state in which a high pressure is applied and another state in which the high pressure is not applied, as in the second embodiment.

Figure 17A:
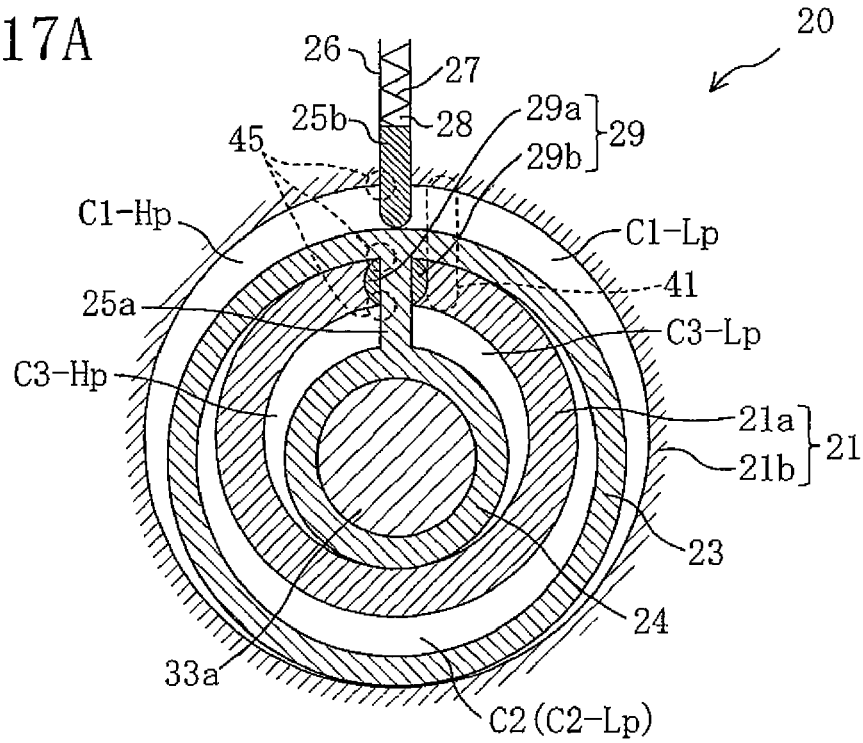
FIG. 17 is a transverse cross-sectional view illustrating a compression mechanism of the third embodiment.
Figure 17B:
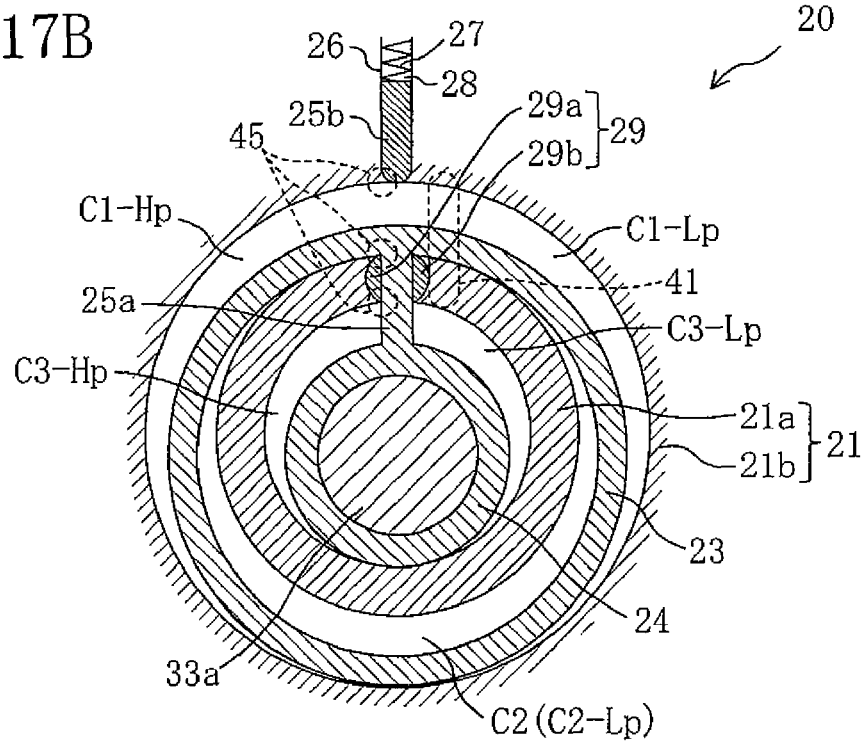

The external side blade member (25*b*) moves backward/forward to enter either (i) a first state (see FIG. 17(A)) in which the tip is brought into sliding contact with the external peripheral surface of the first ring-like piston (23) by application of the high pressure to the blade back chamber (28) or (ii) a second state (see FIG. 17(B)) in which the tip moves away from the external peripheral surface of the first ring-like piston (23) when the high pressure stops working on the blade back chamber (28). In other words, for the first state, the external side cylinder chamber (C1) is divided by the external side blade member (25*b*) into the high pressure chamber (C1-Hp) and the low pressure chamber (C1-Lp) and for the case of the second state, the external side cylinder chamber (C1) is not subjected to division, but is placed in the form of an undivided single space. As a result of this, in the first state, the compression of refrigerant is carried out in each of the three cylinder chambers (C1, C2, C3) while in the second state, the compression of refrigerant is carried out only in the intermediate cylinder chamber (C2) and the internal side cylinder chamber (C3). Other configurations, operations, and working-effects are the same as described in the first embodiment.

Variation of the Third Embodiment

In the arrangement of the third embodiment, the external side cylinder chamber (C1) is placed in the form of an undivided single space. However, in the present variation of the third embodiment, the internal side cylinder chamber (C3) is placed in the form of an undivided single space, as shown in FIG. 18. Also note that in the present variation, the circular cylinder-like piston (24) is provided as an internal piston part; the lower housing (19) is omitted; and the drive shaft (33) is not passed through the cylinder chambers (C1, C2, C3), as in the first embodiment.

More specifically, the external side blade member (25*b*) is formed integrally with the external side cylinder part (21*a*) and the internal side cylinder part (21*b*). The external side blade member (25*b*) is formed such that it extends from the internal peripheral surface of the external side cylinder part (21*a*) to the external peripheral surface of the internal side cylinder part (21*b*) in the radial direction of the cylinder (21), and is inserted through the swinging bush (29) mounted in the cutaway portion of the ring-like piston (23). Accordingly, the external side cylinder chamber (C1) is always divided by the external side blade member (25*b*) into the high pressure chamber (C1-Hp) and the low pressure chamber (C1-Lp) and the intermediate cylinder chamber (C2) is always divided by the external side blade member (25*b*) into the high pressure chamber (C2-Hp) and the low pressure chamber (C2-Lp).

The internal side blade member (25*a*) is inserted advanceably/retractably along the radial direction of the circular cylinder-like piston (24) into the blade groove (26) formed in the circular cylinder-like piston (24). The blade back chamber (28) of the blade groove (26) is provided with a spring (27) by which the internal side blade member (25*a*) is biased inwardly in the radial direction of the circular cylinder-like piston (24). And the blade back chamber (28) is configured such that it is switchable between one state in which a high pressure is applied and another state in which the high pressure is not applied, as in the first embodiment.

Figure 18A:
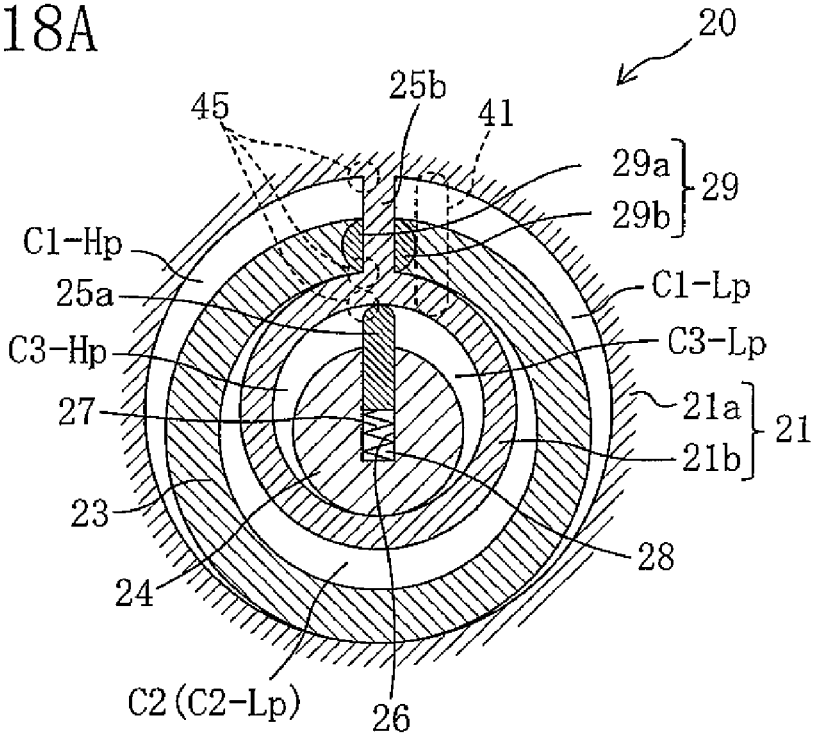
FIG. 18 is a transverse cross-sectional view illustrating a compression mechanism according to an example of the modification of the third embodiment.
Figure 18B:
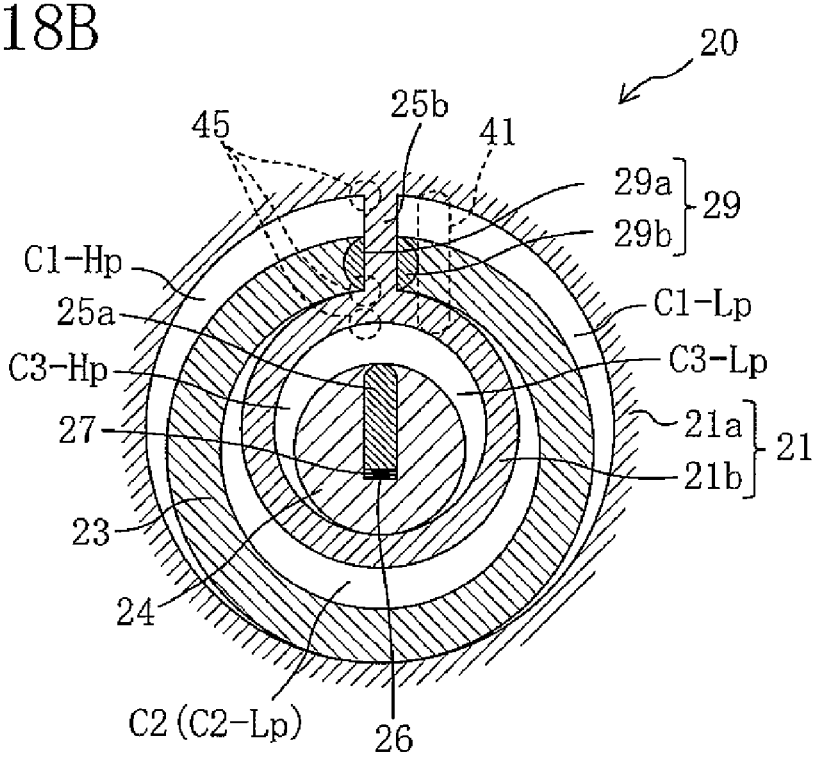
Figure 19:
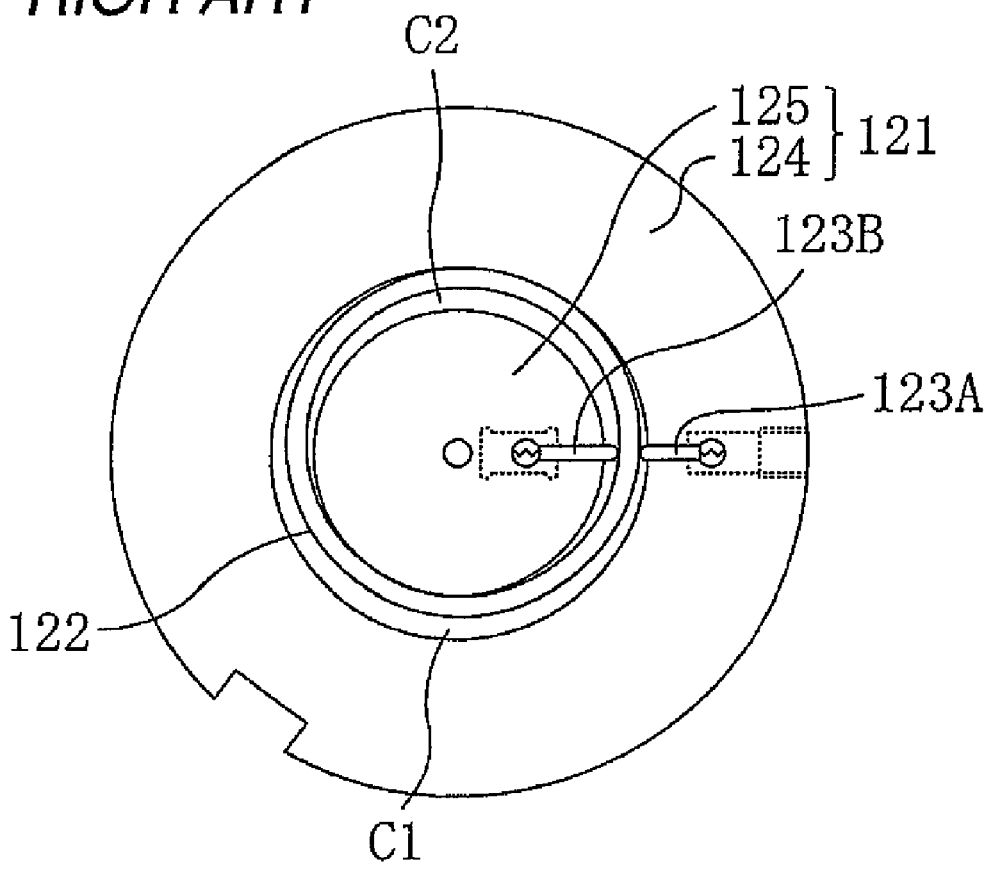
FIG. 19 PRIOR ART
FIG. 19 is a transverse cross-sectional view illustrating a conventional compressor.

The internal side blade member (25*a*) moves backward/forward to enter either (i) a first state (see FIG. 18(A)) in which the tip is brought into sliding contact with the internal peripheral surface of the internal side cylinder part (21*b*) by application of the high pressure to the blade back chamber (28) or (ii) a second state (see FIG. 18(B)) in which the tip moves away from the internal peripheral surface of the internal side cylinder part (21*b*) when the high pressure stops working on the blade back chamber (28). In other words, for the first state, the internal side cylinder chamber (C3) is divided by the internal side blade member (25*a*) into the high pressure chamber (C3-Hp) and the low pressure chamber (C3-Lp) and for the case of the second state, the external side cylinder chamber (C1) is not subjected to division, but is placed in the form of an undivided single space. As a result of this, in the first state, the compression of refrigerant is carried out in each of the three cylinder chambers (C1, C2, C3) while in the second state, the compression of refrigerant is carried out only in the external side cylinder chamber (C1) and the intermediate cylinder chamber (C2). Other configurations, operations, and working-effects are the same as described in the first embodiment.

Another Embodiment

For example, in each of the foregoing embodiments, description has been made in regard to the compressor (1) having the three cylinder chambers (C1, C2, C3). Nonetheless, the present invention can be applied, for example, to a compressor having the two cylinder chambers (C1, C2) with omission of the circular cylinder-like piston (24) in the same way as described above. For example, for the case of the first embodiment, the internal side cylinder part (21*b*) is provided with a blade groove, and the blade (25) is moved backward/forward from the blade groove to a predetermined position.

It should be noted that the above-descried embodiments are essentially preferable exemplifications which are not intended in any sense to limit the scope of the present invention, its application, or its application range.

INDUSTRIAL APPLICABILITY

As has been described above, the present invention finds its utility in the field of fluid machines of the rotary type having a plurality of cylinder chambers in radial direction and configured to divide a cylinder chamber into a high pressure chamber and a low pressure chamber by means of a blade.

What is claimed is:

1. A rotary type fluid machine comprising:

a cylinder having a ring-shaped cylinder chamber;

a ring-shaped piston disposed eccentrically relative to the cylinder in the cylinder chamber to divide the cylinder chamber into an external side cylinder chamber and an internal side cylinder chamber; and a blade arranged to pass through the ring-shaped piston to divide the external side cylinder chamber into a high pressure chamber and a low pressure chamber and to divide the internal side cylinder chamber into a high pressure chamber and a low pressure chamber, the cylinder and the ring-shaped piston being configured to move relatively in an eccentric rotation motion, and the blade is a single body configured to be advanceable/retractable in a longitudinal direction thereof such that the rotary fluid machine is changeable between a first state and a second state;

in the first state the blade divides both the external side cylinder chamber into the high pressure chamber and the low pressure chamber and the internal side cylinder chamber into the high pressure chamber and the low pressure chamber, in the second state at least one of the external side cylinder chamber and the internal side cylinder chamber is an undivided single space during one rotational movement.

2. The rotary type fluid machine of claim 1, wherein the ring-shaped piston is C-shaped to form a cutaway portion through which the blade is allowed to pass, the blade is inserted advanceably/retractably along the radial direction of the cylinder into a blade groove formed within a wall on an internal peripheral side of the cylinder chambers, and the blade moves backward/forward to enter either the first state or the second state, the tip of the blade being in sliding contact with a wall surface on an external peripheral side of the cylinder chamber to divide the external side cylinder chamber into the high pressure chamber and the low pressure chamber and to divide the internal side cylinder chamber into the high pressure chamber and the low pressure chamber in the first state, and the tip of the blade being positioned in the cutaway portion of the ring-shaped piston such that only the external side cylinder chamber is an undivided single space in the second state.

3. The rotary type fluid machine of claim 2, wherein the blade moves backward/forward to enter a third state in which the tip of the blade is positioned in the blade groove such that the external side cylinder chamber and the internal side cylinder chamber are respective undivided single spaces.

4. The rotary type fluid machine of claim 1, wherein the ring-shaped piston is C-shaped to form a cutaway portion through which the blade is allowed to pass, the blade is inserted advanceably/retractably along the radial direction of the cylinder into a blade groove formed in a wall on an external peripheral side of the cylinder chamber, and the blade moves backward/forward to enter either the first state or the second state, the tip of the blade being in sliding contact with a wall surface on the internal peripheral side of the cylinder chamber to divide the external side cylinder chamber into the high pressure chamber and the low pressure chamber and to divide the internal side cylinder chamber into the high pressure chamber and the low pressure chamber in the first state, and the tip of the blade being positioned in the cutaway portion of the ring-shaped piston such that only the internal side cylinder chamber is an undivided single space in the second state.

5. The rotary type fluid machine of claim 4, wherein the blade moves backward/forward to enter a third state in which the tip of the blade is positioned in the blade groove such that the external side cylinder chamber and the internal side cylinder chamber are respective undivided single spaces.

6. A rotary type fluid machine comprising:

a cylinder having an internal side cylinder part and an external side cylinder part, the internal side cylinder part and the external side cylinder part defining an internal side cylinder chamber and a ring-shaped external side cylinder chamber;

a piston having an internal piston part which is disposed in the internal side cylinder chamber and an external piston part which is disposed in the ring-shaped external side cylinder chamber to divide the ring-shaped external side cylinder chamber into an external side cylinder chamber and an intermediate cylinder chamber, the internal piston part and the external piston part being eccentric relative to the cylinder; and a blade is a single body configured to divide the internal side cylinder chamber into a high pressure chamber and a low pressure chamber, to divide the intermediate cylinder chamber into a high pressure chamber and a low pressure chamber, and to divide the external side cylinder chamber into a high pressure chamber and a low pressure chamber, the cylinder and the piston being configured to move relatively in an eccentric rotation motion, and the blade being configured to be advanceable/retractable in a longitudinal direction thereof such that the rotary fluid machine is changeable between a first state and a second state;

in the first state the blade divides the internal side cylinder chamber into a high pressure chamber and a low pressure chamber, the intermediate cylinder chamber into a high pressure chamber and a low pressure chamber, and the external side cylinder chamber into a high pressure chamber and a low pressure chamber, in the second state at least one of the internal side cylinder chamber and the external side cylinder chamber is of an undivided single space during one rotational movement.

7. The rotary type fluid machine of claim 6, wherein the external piston part and the internal side cylinder part are each C-shaped to form respective cutaway portions through which the blade is allowed to pass, the blade includes a single body which is inserted advanceably/retractably in a radial direction of the internal piston part into a blade groove formed in the internal piston part, and the blade moves backward/forward to enter either the first state, the second state or a third state, the tip of the blade being in sliding contact with an internal peripheral surface of the external side cylinder part to divide the external side cylinder chamber into the high pressure chamber and the low pressure chamber, to divide the intermediate cylinder chamber into the high pressure chamber and the low pressure chamber, and to divide the internal side cylinder chamber into the high pressure chamber and the low pressure chamber in the first state, the tip of the blade being is positioned in the cutaway portion of the external piston part such that only the external side cylinder chamber is an undivided single space in the second state, and the tip of the blade being positioned in the cutaway portion of the internal side cylinder part such that only the external side cylinder chamber and the intermediate cylinder chamber are respective undivided single spaces in the third state.

8. The rotary type fluid machine of claim 7, wherein the blade moves backward/forward to enter a fourth state in which the tip of the blade is positioned in the blade groove such that the external side cylinder chamber, the intermediate cylinder chamber, and the internal side cylinder chamber are respective undivided single spaces.

9. The rotary type fluid machine of claim 6, wherein the external piston part and the internal side cylinder part are each C-shaped to form respective cutaway portions through which the blade is allowed to pass, the blade including a single body which is inserted advanceably/retractably in the radial direction of the external side cylinder part into a blade groove formed in the external side cylinder part, and the blade moves backward/forward to enter either the first state, the second state or a third state, the tip of the blade being in sliding contact with an external peripheral surface of the internal piston part to divide the external side cylinder chamber into the high pressure chamber and the low pressure chamber, to divide the intermediate cylinder chamber into the high pressure chamber and the low pressure chamber, and to divide the internal side cylinder chamber into the high pressure chamber and the low pressure chamber in the first state, the tip of the blade being positioned in the cutaway portion of the internal side cylinder part such that only the internal side cylinder chamber is an undivided single space in the second state, and the tip of the blade being positioned in the cutaway portion of the external piston part such that only the internal side cylinder chamber and the intermediate cylinder chamber are respective undivided single spaces in the third state.

10. The rotary type fluid machine of claim 9, wherein the blade moves backward/forward to enter a fourth state in which the tip of the blade is positioned in the blade groove such that the external side cylinder chamber, the intermediate cylinder chamber, and the internal side cylinder chamber are respective undivided single spaces.

* * * * *

UNITED STATES PATENT AND TRADEMARK OFFICE

CERTIFICATE OF CORRECTION

PATENT NO. : 7,722,340 B2
APPLICATION NO. : 11/912735
DATED : May 25, 2010
INVENTOR(S) : Masanori Masuda et al.

It is certified that error appears in the above-identified patent and that said Letters Patent is hereby corrected as shown below:

On the cover page change the listing of [56] from

"[56] References Cited

FOREIGN PATENT DOCUMENTS

| | | |
|---|---|---|
| CN | 1166862 C | 9/2004 |
| JP | 60-9058 U | 6/1985 |
| JP | 61-001888 A | 1/1986 |
| JP | 63-6009 U | 4/1988 |

……..."

to

-- [56] References Cited

FOREIGN PATENT DOCUMENTS

| | | |
|---|---|---|
| CN | 1166862 C | 9/2004 |
| JP | 60-90581 U | 6/1985 |
| JP | 61-001888 A | 1/1986 |
| JP | 63-60091 U | 4/1988 |

…….. --

Signed and Sealed this

Twenty-eighth Day of September, 2010

David J. Kappos

David J. Kappos
*Director of the United States Patent and Trademark Office*